US006028558A

United States Patent [19]

Van Voorhies

[11] Patent Number: 6,028,558

[45] Date of Patent: Feb. 22, 2000

[54] TOROIDAL ANTENNA

[76] Inventor: Kurt L. Van Voorhies, 555 S. Woodward Ave., Apartment 508, Birmingham, Mich. 48009-6669

[21] Appl. No.: 08/486,340

[22] Filed: Jun. 7, 1995

Related U.S. Application Data

[63] Continuation-in-part of application No. 07/992,970, Dec. 15, 1992, Pat. No. 5,442,369.

[51] Int. Cl.[7] ..... H01Q 11/12

[52] U.S. Cl. ..... 343/742; 343/744; 343/866

[58] Field of Search ..... 343/742, 743, 343/744, 866, 867, 788, 870, 895

[56] References Cited

U.S. PATENT DOCUMENTS

| | | | |
|---|---|---|---|
| 3,284,801 | 11/1966 | Bryant | 343/743 |
| 3,646,562 | 2/1972 | Acker et al. | 343/720 |
| 3,671,970 | 6/1972 | Layton | 343/120 |
| 3,721,989 | 3/1973 | Christensen | 343/701 |
| 4,622,558 | 11/1986 | Corum | 343/742 |
| 4,751,515 | 6/1988 | Corum | 343/742 |
| 4,999,642 | 3/1991 | Wells | 343/822 |
| 5,159,332 | 10/1992 | Walton | 340/825.54 |
| 5,257,033 | 10/1993 | Roche | 343/742 |
| 5,442,369 | 8/1995 | Van Voorhies et al. | 343/742 |
| 5,734,353 | 3/1998 | Van Voorhies | 343/742 |
| 5,952,978 | 9/1999 | Van Voorhies | 343/742 |

FOREIGN PATENT DOCUMENTS

| | | | |
|---|---|---|---|
| 043591A1 | 1/1982 | European Pat. Off. | H01Q 11/08 |
| 3823972A1 | 1/1990 | Germany | H01Q 7/00 |
| 7146386 | 6/1995 | Japan | G21B 1/00 |

OTHER PUBLICATIONS

"Time–Varying Electric and Magnetic Fields" by J.M. Ham, G.R. Slemon from *Scientific Basis of Electrical Engineering*; pp. 302–305; 1961.

Reference Data for Radio Engineers; 7th Ed. E. C. Jordan Ed.; Howard W. Sams; pp. 6–13–6–14.

"Wide–Frequency–Range Tuned Helical Antennas and Circuits" by A.G. Kandoian, W. Sichak; Fed. Telecommunication Laboratories, Inc.; pp. 42–47; 1953.

"Modified Contra–Wound Helix Circuits for High–Power Traveling–Wave Tubes" by C.K. Birdsall, T.E. Everhart; from IRE Transactions on Electron Devices; pp. 190–206; Oct. 1956.

"Time Harmonic Electromagnetic Fields" by R.F. Harrington; pp. 106–111; 1961.

"Energy and the Environment: A Continuing Partnership" by K. L. Van Voorhies, J. E. Smith; 26th Intersociety Energy Conversion Engineering Conference; 6 pp.; Aug. 1991.

*Primary Examiner*—Hoanganh T. Le
*Assistant Examiner*—Tan Ho
*Attorney, Agent, or Firm*—Arnold B. Silverman; Kirk D. Houser; Eckert Seamans Cherin & Mellott, LLC

[57] ABSTRACT

An antenna is disclosed that has windings that are contrawound in segments on a toroid form and that have opposed currents on selected segments. An antenna is disclosed that has one or more insulated conductor circuits with windings that are contrawound around and over a multiply connected surface, such as a toroidal surface. The insulated conductor circuits may form one or more endless conductive paths around and over the multiply connected surface. The windings may have a helical pattern, poloidal peripheral pattern or may be constructed from a slotted conductor on the toroid. Poloidal loop winds are disclosed with a toroid hub on a toroid that has two plates that provides a capacitive feed to the loops, which are selectively connected to one of the plates. Associated methods are also disclosed.

31 Claims, 17 Drawing Sheets

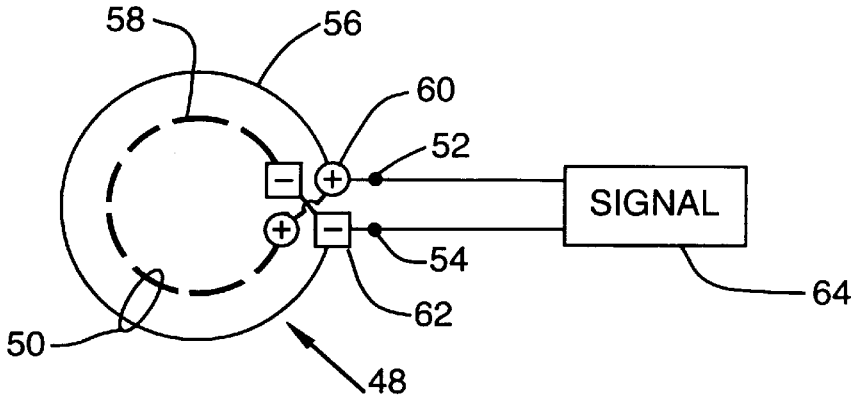
FIG. 48
FIG. 49
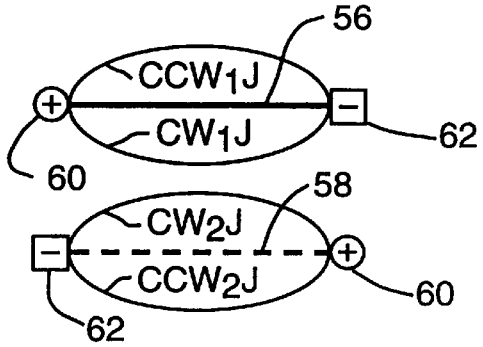
FIG. 50
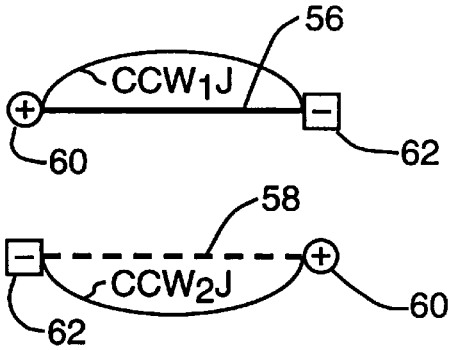
FIG. 51
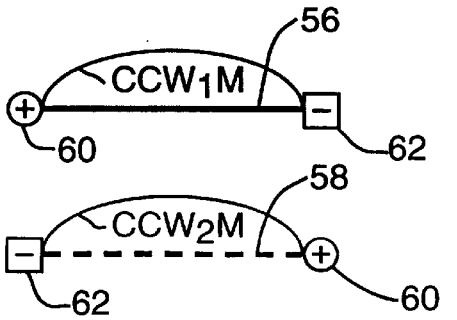

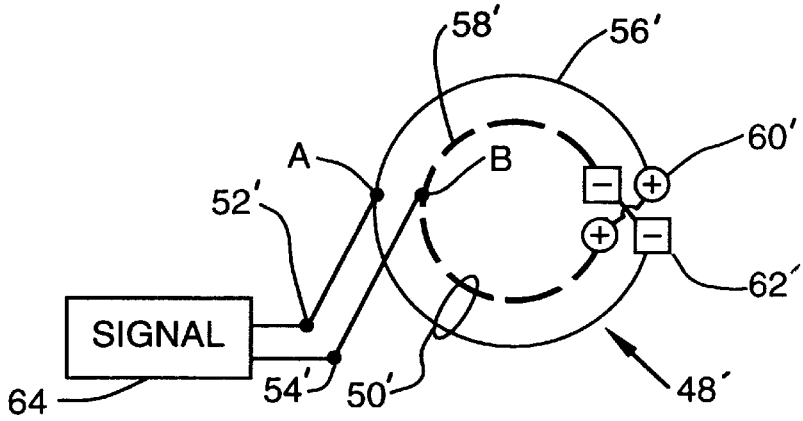
FIG. 52
FIG. 53
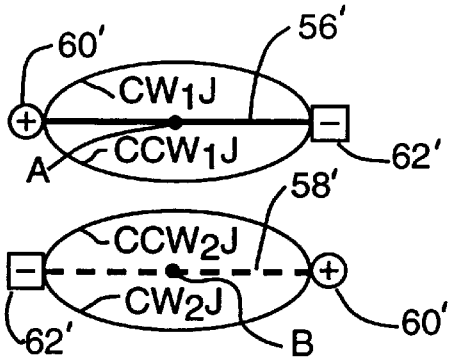
FIG. 54
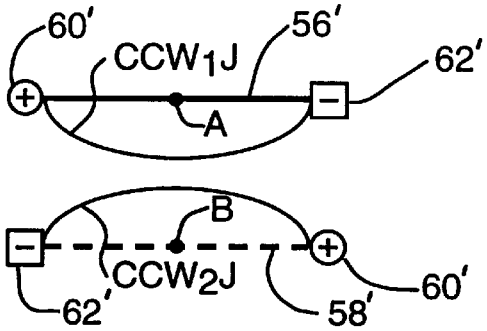
FIG. 55
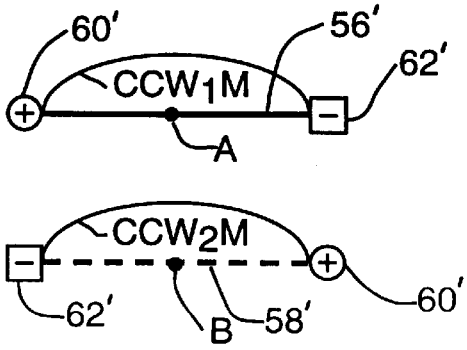

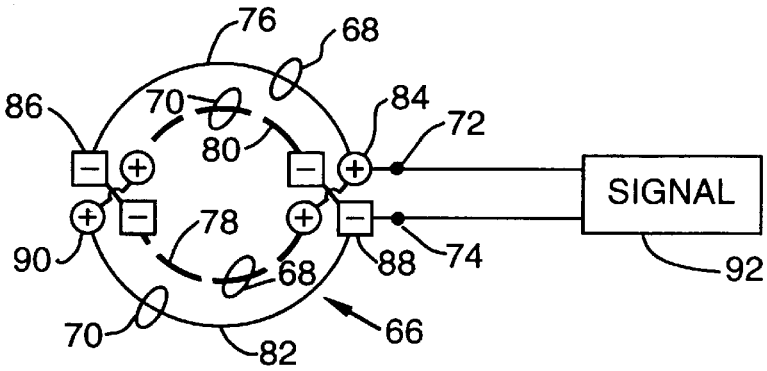
FIG. 56
FIG. 57
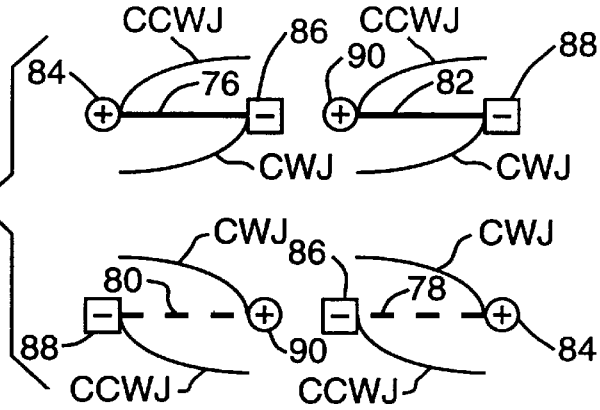
FIG. 58
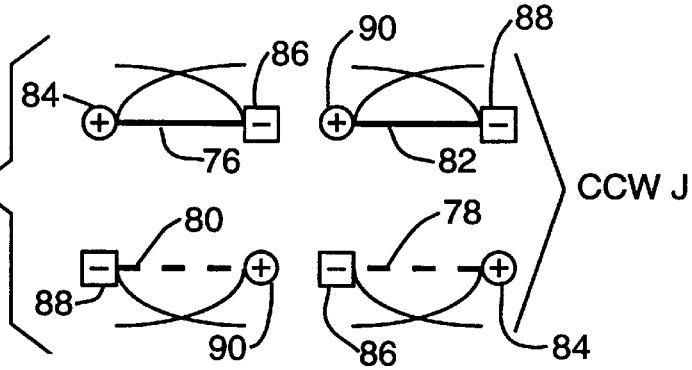
FIG. 59
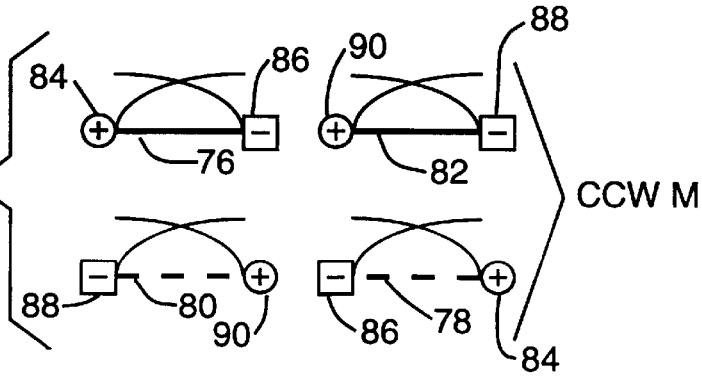

TOROIDAL ANTENNA

This is a continuation-in-part of application Ser. No. 07/992,970, filed Dec. 15, 1992, now U.S. Pat. No. 5,442,369 and entitled "Toroidal Antenna".

TECHNICAL FIELD

This invention relates to transmitting and receiving antennas, and in particular, helically wound antennas.

BACKGROUND OF THE INVENTION

Antenna efficiency at a frequency of excitation is directly related to the effective electrical length, which is related to the signal propagation rate by the well known equation using the speed of light C in free space, wavelength λ, and frequency f:

$$\lambda = C/f$$

As is known, antenna electrical length should be one wavelength, one half wavelength (a dipole) or one quarter wavelength with a ground plane to minimize all but real antenna impedances. When these characteristics are not met, antenna impedance changes creating standing waves on the antenna and antenna feed (transmission line), increasing the standing wave ratio all producing energy loss and lower radiated energy.

A typical vertical whip antenna (a monopole) possesses an omnidirectional vertically polarized pattern, and such an antenna can be comparatively small at high frequencies, such as UHF. However, at lower frequencies the size becomes problematic, leading to the very long lines and towers used in the LF and MF bands. The long range transmission qualities in the lower frequency bands are advantageous but the antenna, especially a directional array can be too large to have a compact portable transmitter. Even at high frequencies, it may be advantageous to have a physically smaller antenna with the same efficiency and performance as a conventional monopole or dipole antenna.

Over the years different techniques have been tried to create compact antennas with directional characteristics, especially vertical polarization, which has been found to be more efficient (longer range) than horizontal polarization, the reason being the horizontally polarized antennae sustain more ground wave losses.

In terms of directional characteristics, it is recognized that with certain antenna configurations it is possible to negate the magnetic field produced in the antenna in a particular polarization and at the same time increase the electric field, which is normal to the magnetic field. Similarly, it is possible to negate the electric field and at the same time increase the magnetic field.

The equivalence principle is a well known concept in the field of electromagnetic arts stating that two sources producing the same field inside a given region are said to be equivalent, and that equivalence can be shown between electric current sources and corresponding magnetic current sources. This is explained in Section 3–5 of the 1961 reference *Time Harmonic Electromagnetic Fields* by R. F. Harrington. For the case of a linear dipole antenna element which carries linear electric currents, the equivalent magnetic source is given by a circular azimuthal ring of magnetic current. A solenoid of electric current is one obvious way to create a linear magnetic current. A solenoid of electric current disposed on a toroidal surface is one way of creating the necessary circular azimuthal ring of magnetic current.

The toroidal helical antenna consists of a helical conductor wound on a toroidal form and offers the characteristics of radiating electromagnetic energy in a pattern that is similar to the pattern of an electric dipole antenna with an axis that is normal to the plane of and concentric with the center of the toroidal form. The effective transmission line impedance of the helical conductor retards, relative to free space propagation rate, the propagation of waves from the conductor feed point around the helical structure. The reduced velocity and circular current in the structure makes it possible to construct a toroidal antenna as much as an order of magnitude or more smaller that the size of a corresponding resonant dipole (linear antenna). The toroidal design has low aspect ratio, since the toroidal helical design is physically smaller than the simple resonant dipole structure, but with similar electrical radiation properties. A simple single-phase feed configuration will give a radiation pattern comparable to a ½ wavelength dipole, but in a much smaller package.

In that context, U.S. Pat. Nos. 4,622,558 and 4,751,515 discusses certain aspects of toroidal antennas as a technique for creating a compact antenna by replacing the conventional linear antenna with a self resonant structure that produces vertically polarized radiation that will propagate with lower losses when propagating over the earth. For low frequencies, self-resonant vertical linear antennas are not practical, as noted previously, and the self-resonant structure explained in these patents goes some way to alleviating the problem of a physically unwieldy and electrically inefficient vertical elements at low frequencies.

The aforementioned patents initially discuss a monofilar toroidal helix as a building block for more complex directional antennas. Those antennas may include multiple conducting paths fed with signals whose relative phase is controlled either with external passive circuits or due to specific self resonant characteristics. In a general sense, the patents discuss the use of so called contrawound toroidal windings to provide vertical polarization. The contrawound toroidal windings discussed in these patents are of an unusual design, having only two terminals, as described in the reference Birdsall, C. K., and Everhart, T. E., "Modified Contra-Wound Helix Circuits for High-Power Traveling Wave Tubes", *IRE Transactions on Electron Devices,* October, 1956, p. 190. The patents point out that the distinctions between the magnetic and electric fields/currents and extrapolates that physically superimposing two monofilar circuits which are contrawound with respect to one another on a toroid a vertically polarized antenna can be created using a two port signal input. The basis for the design is the linear helix, the design equations for which were originally developed by Kandoian & Sichak in 1953 (mentioned the U.S. Pat. No. 4,622,558).

The prior art, such as the aforementioned patents, speaks in terms of elementary toroidal embodiments as elementary building blocks to more complex structures, such as two toroidal structures oriented to simulate contrawound structures. For instance, the aforementioned patent discusses a torus (complex or simple) that is intended to have an integral number of guided wavelengths around the circumference of the circle defined by the minor axis of the torus.

A simple toroidal antenna, one with a monofilar design, responds to both the electric and magnetic field components of the incoming (received) or outputed (transmitted) signals. On the other hand, multifilar (multiwinding) may have the same pitch sense or different pitch sense in separate windings on separate toroids, allowing providing antenna directionality and control of polarization. One form of helix is in the form of a ring and bridge design, which exhibits some but not all of the qualities of a basic contrawound winding configuration.

As is known, a linear solenoidal coil creates a linear magnetic field along its central axis. The direction of the magnetic field is in accordance with the "right hand rule", whereby if the fingers of a right hand are curled inward towards the palm and pointed in the direction of the circular current flow in the solenoid, then the direction of the magnetic field is the same as that of the thumb when extended parallel to the axis about which the fingers are curled. (See e.g. FIG. 47, infra.) When this rule is applied for solenoid coils wound in a right-hand sense, as in a right-hand screw thread, both the electric current and the resulting magnetic field point in the same direction, but a coil in a left-hand sense, has the electric current and resulting magnetic field point in opposite directions. The magnetic field created by the solenoidal coil is sometimes termed a magnetic current. By combining a right-hand and left-hand coil on the same axis to create a contra-wound coil and feeding the individual coil elements with oppositely directed currents, the net electric current is effectively reduced to zero, while the net magnetic field is doubled from that of the single coil alone.

As is also known, a balanced electrical transmission line fed by a sinusoidal AC source and terminated with a load impedance propagates waves of currents from the source to the load. The waves reflect at the load and propagate back towards the source, and the net current distribution on the transmission line is found from the sum of the incident and reflected wave components and can be characterized as standing waves on the transmission line. (See e.g. FIG. 13, infra.) With a balanced transmission line, the current components in each conductor at any given point along the line are equal in magnitude but opposite in polarity, which is equivalent to the simultaneous propagation of oppositely polarized by equal magnitude waves along the separate conductors. Along a given conductor, the propagation of a positive current in one direction is equivalent to the propagation of a negative current in the opposite direction. The relative phase of the incident and reflected waves depends upon the impedance of the load element, $Z_L$. For $I_0$=incident current signal and $I_1$=reflected current signal, with reference to FIG. 13, infra. then the reflection coefficient ρi is defined as:

$$\rho_i = \frac{I_1}{I_0} = \frac{-I_1'}{I_0} = \frac{\frac{Z_L}{Z_0} - 1}{\frac{Z_L}{Z_0} + 1}$$

Since the incident and reflected currents travel in opposite directions, the equivalent reflected current, $I_1'=-I_1$ gives the magnitude of the reflected current with respect to the direction of the incident current $I_0$.

DISCLOSURE OF THE INVENTION

An object of the present invention is to provide a compact vertically polarized antenna, especially suited to low frequency long distance wave applications, but useful at any frequency where a physically low profile or inconspicuous antenna package is desirable.

It is also an object of the present invention to provide an antenna which has a relatively low physical profile with respect to known prior art antennas.

It is a further object of the present invention to provide a physically low profile antenna which has a communication range that is extended relative to known prior art antennas.

It is a still further object of the present invention to provide an antenna which is linearly polarized and has a physically low profile along the direction of polarization.

It is yet a further object of the present invention to provide an antenna which is generally omnidirectional in directions that are normal to the direction of polarization.

It is another further object of the present invention to provide an antenna having a maximum radiation gain in directions normal to the direction of polarization and a minimum radiation gain in the direction of polarization.

It is still another further object of the present invention to provide an antenna having a simplified feed configuration that is readily matched to a radio frequency (RF) power source.

It is yet another further object of the present invention to provide an antenna which operates over as wide a bandwidth as possible with respect to the nominal operating frequency thereof.

According to the present invention a toroidal antenna has a toroidal surface and first and second windings that comprise insulated conductors each extending as a single closed circuit around the surface in segmented helical pattern. The toroid has an even number of segments, e.g. four segments, but generally greater than or equal to two segments. Each part of one of the continuous conductors within a given segment is contrawound with respect to that part of the same conductor in the adjacent segments. Adjacent segments of the same conductor meet at nodes or junctions (winding reversal points). Each of the two continuous conductors are contrawound with respect to each other within every segment of the toroid. A pair of nodes (a port) is located at the boundary between each adjacent pairs of segments. From segment to segment, the polarity of current flow from an unipolar signal source is reversed through connections at the port with respect to the conductors to which the port's nodes are connected. According to the invention, the conductors at the junctions located at every other port are severed and the severed ends are terminated with matched purely reactive impedances which provides for a 90 degree phase shift of the respective reflected current signals. This provides for the simultaneous cancellation of the net electric currents and the production of a quasi-uniform azimuthal magnetic current within the structure creating vertically polarized electromagnetic radiation.

According to the invention, a series of conductive loops are "poloidally" disposed on, and equally spaced about, a surface of revolution such that the major axis of each loop forms a tangent to the minor axis of the surface of revolution. Relative to the major axis of the surface of revolution, the centermost ends of all loops are connected together at one terminal, and the remaining ends of all loops are connected together at a second terminal. A unipolar signal source is applied across the two terminals and since the loops are electrically connected in parallel, the magnetic fields produced by all loops are in phase thus producing a quasi-uniform azimuthal magnetic field, causing vertically polarized omnidirectional radiation.

According to the invention, the number of loops is increased, the conductive elements becoming conductive surface of revolution, which could be either continuous or radially slotted. The operating frequency is lowered by introducing either series inductance or parallel capacitance relative to the composite antenna terminals.

According to the invention, capacitance may be added with the addition of a pair of parallel conductive plates which act as a hub to a conductive surface of revolution. The surface of revolution is slit at the junction with the plates, with one plate being electrically connected to one side of the slit, and a second plate being connected to the other side of the slit. The conductive surface of revolution may be further slitted radially to emulate a series of elementary loop antennas. The bandwidth of the structure may be increased if the radius and shape of the surface of revolution are varied with the corresponding angle of revolution.

According to the invention, an electromagnetic antenna has a multiply connected surface having a major radius and a minor radius, with the major radius being at least as great as the minor radius; an insulated conductor means extending in a first helical conductive path around and over the multiply connected surface with a first helical pitch sense from a first node to a second node, the insulated conductor means also extending in a second helical conductive path around and over the multiply connected surface with a second helical pitch sense, which is opposite from the first helical pitch sense, from the second node to the first node in order that the first and second helical conductive paths are contrawound relative to each other and form a single endless conductive path around and over the multiply connected surface; and first and second signal terminals respectively electrically connected to the first and second nodes.

According to the invention, an electromagnetic antenna has a multiply connected surface having a major radius and a minor radius, with the major radius being at least as great as the minor radius; an insulated conductor means extending in a first poloidal-peripheral winding pattern around and over the multiply connected surface with a first winding sense from a first node to a second node, the insulated conductor means also extending in a second poloidal-peripheral winding pattern around and over the multiply connected surface with a second winding sense, which is opposite from the first winding sense, from the second node to the first node in order that the first and second poloidal-peripheral winding patterns are contrawound relative to each other and form a single endless conductive path around and over the multiply connected surface; and first and second signal terminals respectively electrically connected to the first and second nodes.

According to the invention, an electromagnetic antenna has a multiply connected surface having a major radius and a minor radius, with the major radius being at least as great as the minor radius; an insulated conductor means extending in a first generally helical conductive path around and over the multiply connected surface with a first helical pitch sense from a first node to a second node and from the second node to a third node, the insulated conductor means also extending in a second generally helical conductive path around and over the multiply connected surface with a second helical pitch sense, which is opposite from the first helical pitch sense, from the third node to a fourth node and from the fourth node to the first node in order that the first and second generally helical conductive paths are contrawound relative to each other and form a single endless conductive path around and over the multiply connected surface; and first and second signal terminals respectively electrically connected to the second and fourth nodes.

According to the invention, an electromagnetic antenna has a multiply connected surface having a major radius and a minor radius, with the major radius being at least as great as the minor radius; a first insulated conductor means extending in a first generally helical conductive path around and partially over the multiply connected surface with a first helical pitch sense from a first node to a second node, and also extending in a second generally helical conductive path around and partially over the multiply connected surface with a second helical pitch sense, which is opposite from the first helical pitch sense, from the second node to the first node in order that the first and second generally helical conductive paths form a first endless conductive path around and substantially over the multiply connected surface; a second insulated conductor means extending in a third generally helical conductive path around and partially over the multiply connected surface with the second helical pitch sense from a third node to a fourth node, and also extending in a fourth generally helical conductive path around and partially over the multiply connected surface with the first helical pitch sense from the fourth node to the third node in order that the third and fourth generally helical conductive paths form a second endless conductive path around and substantially over the multiply connected surface, with the first and third generally helical conductive paths being contrawound relative to the second and fourth generally helical conductive paths, respectively; a first signal terminal means electrically connected to at least one of the first and fourth nodes; and a second signal terminal means electrically connected to at least one of the second and third nodes, the first and second signal terminal means for conducting an antenna signal of the electromagnetic antenna.

According to the invention, a method of transmitting an RF signal with a toroidal antenna includes applying the RF signal to first and second signal terminals in order to induce electric currents of the RF signal therebetween; conducting a first electric current in a first conductor around and over a multiply connected surface having a major radius and a minor radius, with the major radius being at least as great as the minor radius, and with the first conductor having a first helical pitch sense from the first signal terminal to the second signal terminal; conducting a second electric current in a second conductor around and over the multiply connected surface, with the second conductor having a second helical pitch sense, which is opposite from the first helical pitch sense, from the second signal terminal to the first signal terminal; and employing the first and second conductors in a contrawound relationship to each other.

The invention provides a compact, vertically polarized antenna with greater gain for a wider frequency spectrum as compared to a bridge and ring configuration. Other objects, benefits and features of the invention will be apparent to one skilled in the art.

These and other objects of the invention will be more fully understood from the following detailed description of the invention on reference to the illustrations appended hereto.

BRIEF DESCRIPTION OF THE DRAWINGS

FIG. 48 is a schematic illustration of a series fed antenna according to an embodiment of the invention.

FIGS. 49, 50 and 51 are current and magnetic field plots relative to toroidal node positions for the antenna shown in FIG. 48.

FIG. 52 is a schematic illustration of a series fed antenna according to another embodiment of the invention.

FIGS. 53, 54 and 55 are current and magnetic field plots relative to toroidal node positions for the antenna shown in FIG. 52.

FIG. 56 is a schematic illustration of a parallel fed antenna according to another embodiment of the invention.

FIGS. 57, 58 and 59 are current and magnetic field plots relative to toroidal node positions for the antenna shown in FIG. 56.

BEST MODE FOR CARRYING OUT THE INVENTION

Figure 1:
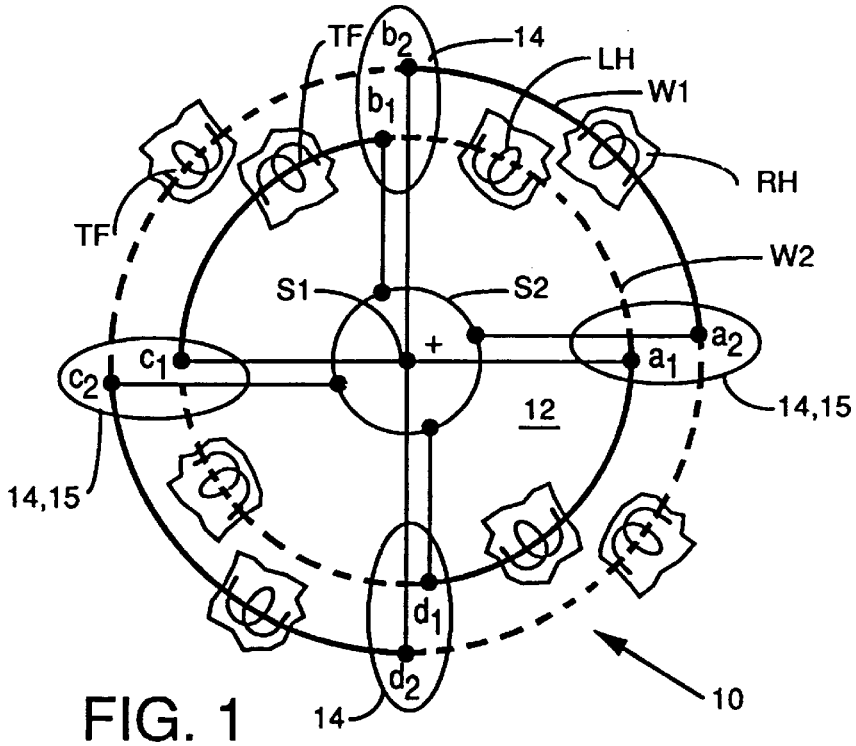
FIG. 1 is a schematic of a four segment helical antenna according to the invention.
Figure 2:
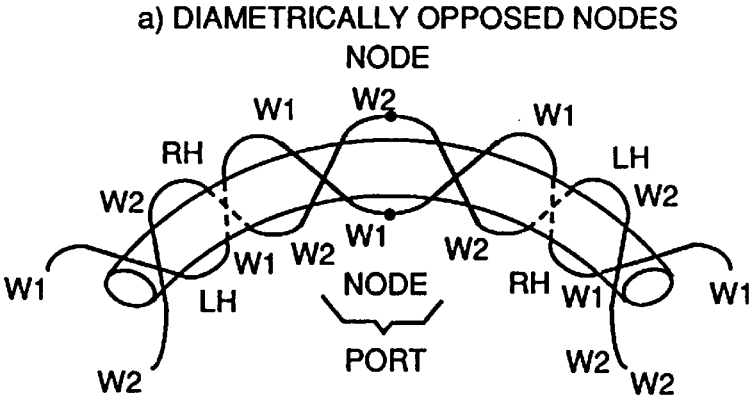
FIG. 2 is an enlarged view of windings in FIG. 1.
Figure 3:
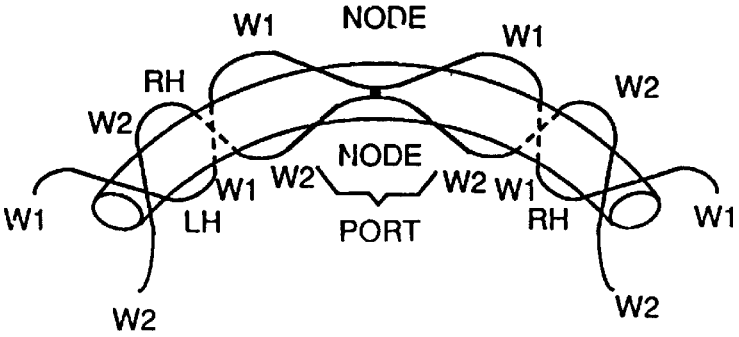
FIG. 3 is an enlarged view of windings in an alternative embodiment of the invention.
Figure 5:
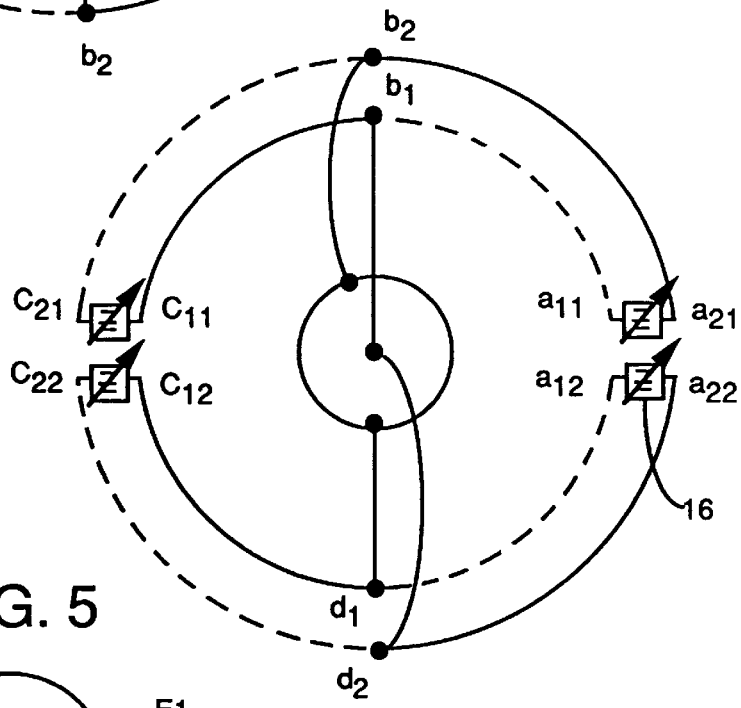
FIG. 5 is two port helical antenna with variable impedances at winding reversal points in an alternate embodiment and for antenna tuning according to the invention.

Referring to FIG. 1, an antenna 10 comprises two electrically insulated closed circuit conductors (windings) W1 and W2 that extend around a toroid form TF through 4 (n=4) equiangular segments 12. The windings are supplied with an RF electrical signal from two pins S1 and S2. Within each segment, the winding "contrawound", that is the source for winding W1 may be right hand (RH), as shown by the dark solid lines, and the same for winding W2 may be left hand (LH) as shown by the broken lines. Each conductor is assumed to have the same number of helical turns around the form, as determined from equations described below. At a junction or node 14 each winding reverses sense (as shown in the cutaway of each). The signal terminals S1 and S2 are connected to the two nodes and each pair of such nodes is termed a "port". In this discussion, each pair of nodes at each of four ports is designated a1 and a2, b1 and b2, c1 and c2 and d1 and d2. In FIG. 1, for instance, there are four ports, a, b, c and d. Relative to the minor axis of TF, at a given port the nodes may be in any angular relation to one another and to the torus, but all ports on the structure will bear this same angular relation if the number of turns in each segment is an integer. For example, FIG. 2 shows diametrically opposed nodes, while FIG. 3 shows overlapping nodes. The nodes overlay each other, but from port to port the connections of the corresponding nodes with terminals or pins S1 and S2 are reversed as shown, yielding a configuration in which diametrically opposite segments have the same connections in parallel, with each winding having the same sense. The result is that in each segment the currents in the windings are opposed but the direction is reversed along with the winding sense from segment to segment. It is possible to increase or decrease the segments so long as there are an even number of segments, but it should be understood that the nodes bear a relationship to the effective transmission line length for the toroid (taking into account the change in propagation velocity due to the helical winding and operating frequency). By altering the node locations the polarization and directionality of the antenna can be controlled, especially with an external impedance 16, as shown in FIG. 5. The four segment configuration shown here, has been found to produce a vertically polarized omnidirectional field pattern having an elevation angle θ from the axis of the antenna and a plurality of electromagnetic waves E1,E2 which emanate from the antenna as illustrated in FIG. 6.

Figure 4:
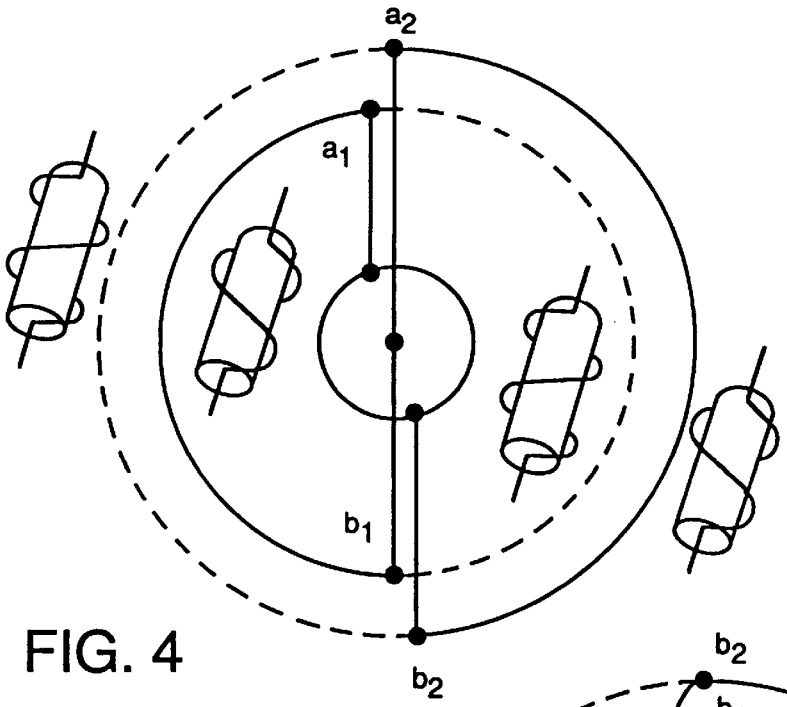
FIG. 4 is a schematic of a two segment (two part) helical antenna embodying the invention.

While FIG. 1 illustrates an embodiment with four segments and FIG. 4 two segments, it should be recognized that the invention can be carried out with any even number of segments, e.g. six segments. One advantage to increasing the number of segments will be to increase the radiated power and to reduce the composite impedance of the antenna feed ports and thereby simplify the task of matching impedance at the signal terminal to the composite impedance of the signal ports on the antenna. The advantage to reducing the number of segments is in reducing the overall size of the antenna.

Figure 6:
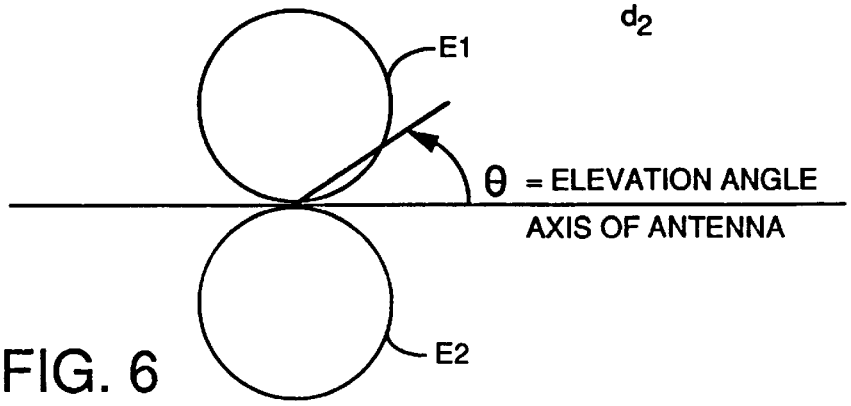
FIG. 6 is a field plot showing the field pattern for the antenna shown in FIG. 1.
Figure 7:
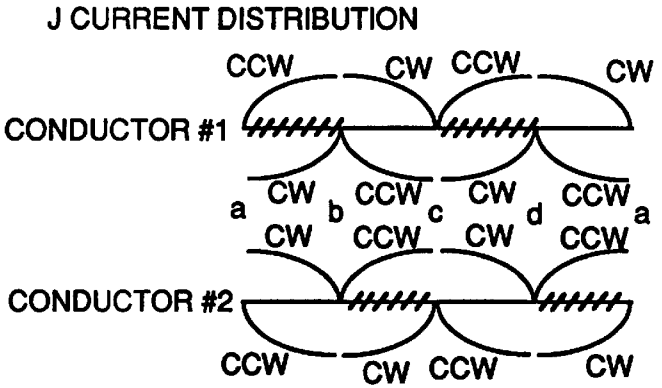
FIGS. 7, 8 and 9 are current and magnetic field plots relative to toroidal node positions for the antenna shown in FIG. 1.
Figure 8:
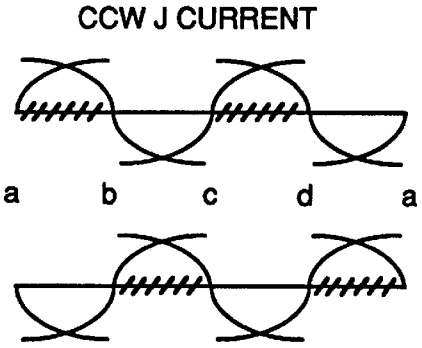
Figure 9:
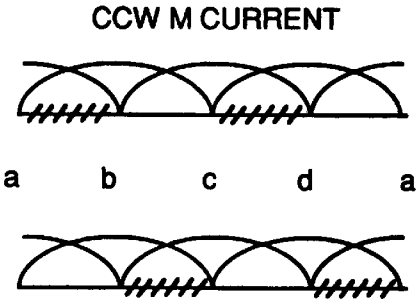
Figure 10:
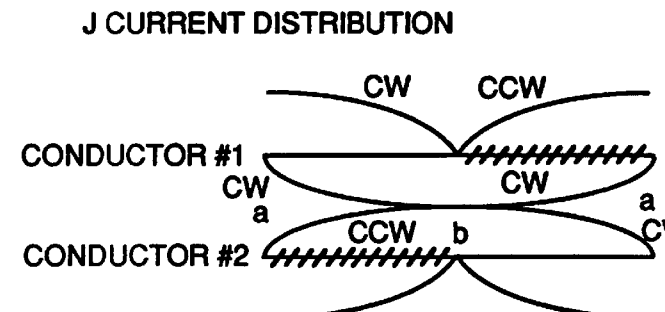
FIGS. 10, 11 and 12 are current and magnetic field plots relative to toroidal positions between nodes for the antenna shown in FIG. 4.
Figure 11:
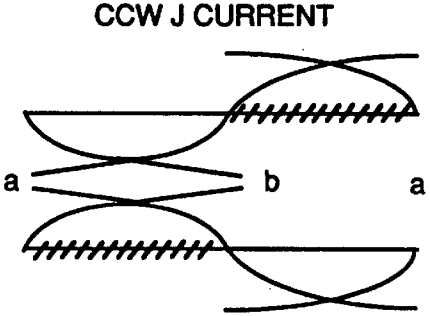
Figure 12:
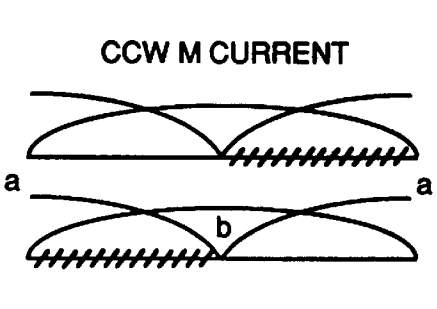

While the primary design goal is to produce a vertically polarized omnidirectional radiation pattern as illustrated in FIG. 6, it has been heretofore recognized through the principle of equivalence of electromagnetic systems and understanding of the elementary electric dipole antenna that this can be achieved through the creation of an azimuthal circular ring of magnetic current or flux. Therefore, the antenna will be discussed with respect to its ability to produce such a magnetic current distribution. With reference to FIG. 1, a balanced signal is applied to the signal terminals S1 and S2. This signal is then communicated to the toroidal helical feed ports a through d via balanced transmission lines. As is known from the theory of balanced transmission lines, at any given point along the transmission line, the currents in the two conductors are 180 degrees out of phase. Upon reaching the nodes to which the transmission line connects, the current signal continues to propagate as a traveling wave in both directions away from each node. These current distributions along with their direction are shown in FIGS. 7–9 for a four segment and FIGS. 10–12 for the two segment antenna respectively and are referenced in these plots to the ports or nodes, where J refers to electric current and M refers to magnetic current. This analysis assumes that the signal frequency is tuned to the antenna structure such than the electrical circumference of the structure is one wavelength in length, and that the current distribution on the structure in sinusoidal in magnitude, which is an approximation. The contrawound toroidal helical winds of the antenna structure are treated as a transmission line, however these form a leaky transmission line due to the radiation of power. The plots of FIGS. 7 and 10 show the electric current distribution with polarity referenced to the direction of propagation away from the nodes from which the signals emanate. The plots of FIGS. 8 and 11 show the same current distribution when referenced to a common counterclockwise direction, recognizing that the polarity of the current changes with respect to the direction to which it is referenced. FIGS. 9 and 12 then illustrate the corresponding magnetic current distribution utilizing the principles illustrated in FIG. 1. FIGS. 8 and 11 show that the net electric current distribution on the toroidal helical structure is canceled. But as FIGS. 9 and 12 show, the net magnetic current distribution is enhanced. Thus those signals in quadrature sum up to form a quasi-uniform azimuthal current distribution.

The following five key elements should be satisfied to carry out the invention: 1) the antenna must be tuned to the signal frequency, i.e. at the signal frequency, the electrical circumferential length of each segment of the toroidal helical structure should be one quarter wavelength, 2) the signals at each node should be of uniform amplitude, 3) the signals at each port should be of equal phase, 4) the signal applied to the terminals S1 and S2 should be balanced, and 5) the impedance of the transmission line segments connecting the signal terminals S1 and S2 to the signal ports on the toroidal helical structure should be matched to the respective loads at each end of the transmission line segment in order to eliminate signal reflections.

When calculating the dimensions for the antenna, the following the following parameters are used in the equations that are used below.

a=the major axis of a torus;

b=the minor axis of the torus

D=2×b=minor diameter of the torus

N=the number of turns of the helical conductor wrapped around the torus;

n=number turns per unit length $V_g$=the velocity factor of the antenna;

a(normalized)=a/λ=$\tilde{a}$ b(normalized)=b/λ=b $L_w$=normalized conductor length $\lambda_g$=the wavelength based on the velocity factor and λ for free space.

m=number of antenna segments

The toroidal helical antenna is at a "resonant" frequency as determined by the following three physical variables:

a=major radius of torus b=minor radius of torus

N=number of turns of helical conductor wrapped around torus

V=guided wave velocity

It has been found that the number of independent variables can be further reduced to two, $V_g$ and N, by normalizing the variables with respect to the free space wavelength λ, and rearranging to form functions a($V_g$) and b($V_g$,N). That is, this physical structure will have a corresponding resonant frequency, with a free space wavelength of λ. For a four segment antenna, resonance is defined as that frequency where the circumference of the torus' major axis is one wavelength long. In general, the resonant operating frequency is that frequency at which a standing wave is created on the antenna structure for which each segment of the antenna is ¼ guided wavelength long (i.e. each node 12 in FIG. 1 is at the ¼ guided wavelength). In this analysis, it is assumed that the structure has a major circumference of one wavelength, and that the feeds and windings are correspondingly configured.

The velocity factor of the antenna is given by:

$$V_g = \frac{V}{c} = \frac{2\pi a}{\lambda} = \frac{4}{m}\frac{L}{\lambda} = \frac{\lambda_g}{\lambda} \tag{1}$$

The physical dimensions of the torus may be normalized with respect to the free space wavelengths as follows:

$$\tilde{a}=a/\lambda \quad \tilde{b}=b/\lambda \tag{2}$$

The reference "Wide-Frequency-Range Tuned Helical Antennas and Circuits" by A. G. Kandoian and W. Sichak in Convention Record of the I.R.E., 1953 National Convention, Part 2—Antennas and Communications, pp.42–47 presents a formula which predicts the velocity factor for a coaxial line with a monofilar linear helical inner conductor. Through substitution of geometric variables, this formula was transformed to a toroidal helical geometry in U.S. Pat. Nos. 4,622,558 and 4,751,515 to give:

$$V_g = \frac{1}{\sqrt{1 + 20\left(\frac{2bN}{L}\right)^{2.5}\left(\frac{2b}{\lambda}\right)^{.5}}} \tag{3}$$

While this formula is based upon a different physical embodiment than the invention described herein, it is useful with minor empirical modification as an approximate description of the present invention for purposes of design to achieve a given resonant frequency.

Substituting (1) and (2) into equation (3) and simplifying, gives:

$$V_g = \frac{1}{\sqrt{1 + 20\left(\frac{2\tilde{b}N}{.25mV_g}\right)^{2.5}(2\tilde{b})^{.5}}} = \frac{1}{\sqrt{1 + 160\left(\frac{N}{.25mV_g}\right)^{2.5}\tilde{b}^{3}}} \tag{4}$$

From equation (1) and (2), the velocity factor and normalized major radius are directly proportional to one another:

$$V_g=2\pi\tilde{a} \tag{5}$$

Thus, equations (4) and (5) may be rearranged to solve for the normalized major and minor torus radii in terms of $V_g$ and N:

$$\tilde{a} = \frac{mV_g}{8\pi} \tag{6}$$

$$\tilde{b} = \left(\frac{(1 - V_g^2)\sqrt{V_g}}{160\left(\frac{4}{m}N\right)^{2.5}}\right)^{\frac{1}{3}} \tag{7}$$

subject to the fundamental property of a torus that:

$$\frac{\tilde{b}}{\tilde{a}} = \frac{b}{a} \le 1 \tag{8}$$

Equations (2), (6), (7), (8) provide the fundamental, frequency independent design relationships. They can be used to either find the physical size of the antenna, for a given frequency of operation, velocity factor, and number of turns, or to solve the inverse problem of determining the operating frequency given an antenna of a specific dimension having a given number of helical turns.

A further constraint based upon the referenced work of Kandoian and Sichak may be expressed in terms of the normalized variables as follows:

$$\frac{nD^2}{\lambda} = \frac{4Nb^2}{L\lambda} = \frac{4N\tilde{b}^2}{.25mV_g} \le \frac{1}{5} \tag{9}$$

Rearranging this to solve for b, and substituting equation (7) gives:

$$\tilde{b} = \left(\frac{(1 - V_g^2)\sqrt{V_g}}{160\left(\frac{4}{m}N\right)^{2.5}}\right)^{\frac{1}{3}} \le \left(\frac{mV_g}{80N}\right)^{\frac{1}{2}} \tag{10}$$

Rearranging equation (10) to separate variables gives:

$$\frac{1 - V_g^2}{V_g} \le \frac{16}{\sqrt{5}}\frac{N}{m} = \alpha \tag{11}$$

The resulting quadratic equation can be solved to give:

$$V_g \ge \frac{-\alpha + \sqrt{\alpha^2 + 4}}{2} \tag{12}$$

Also, from (6) and (8):

$$V_g \ge \frac{8\pi\tilde{b}}{m} \tag{13}$$

Constraint (13), which is derived from constraint (8), appears to be more stringent than constraint (12).

The normalized length of the helical conductor is then given by:

$$\tilde{L}_w = 2\pi\sqrt{(N\tilde{b})^2 + \tilde{a}^2} = 2\pi\tilde{b}\sqrt{N^2 + \left(\frac{\tilde{a}}{\tilde{b}}\right)^2} \tag{14}$$

The wire length will be minimized when a=b and for the minimum number of turns, N. When a=b, then from (6)

$$\tilde{b} = \frac{mV_g}{8\pi} \tag{15}$$

and thus $$\tilde{L}_w = \frac{mV_g}{4}\sqrt{N^2 + 1} > \frac{mV_gN}{4} \tag{16}$$

For a four segment antenna, m=4 and $$\tilde{L}_w > V_gN \tag{17}$$

Substituting equation (15) into equation (10) gives $$V_g N = \left( \frac{\pi^3}{10\sqrt{m}} (1 - V_g^2) \right)^{0.4} \tag{18}$$

For minimum wire length, N=minimum=4, so for a four segment antenna, $$V_g N = 1.151 < \tilde{L}_w \tag{19}$$

In general, the wire length will be smallest for small velocity factors, so equation (18) may be approximated as $$V_g N \approx \left( \frac{\pi^3}{10\sqrt{m}} \right)^{0.4} \tag{20}$$

which when substituted into equation (16) gives $$\tilde{L}_w > m^{.8} \left( \frac{\pi^3}{320} \right)^{0.4} = 0.393 m^{.8} \tag{21}$$

Thus for all but two segment antennas, the equations of Kandoian and Sichak predict that the total wire length per conductor will be greater than the free space wavelength.

From these equations, one can construct a toroid that effectively has the transmission characteristics of a half wave antenna linear antenna. Experience with a number of contrawound toroidal helical antennas constructed according to this invention has shown that the resonant frequency of a given structure differs from that predicted by equations (2), (6) and (7) and in particular the actual resonant frequency appears to correspond to that predicted by equations (2), (6) and (7) when the number of turns N used in the calculations is larger by a factor of two to three than the actual number of turns for one of the two conductors. In some cases, the actual operating frequency appears to be best correlated with the length of wire. For a given length of toroidal helical conductor $L_W$(a,b,N), this length will be equal to the free space wavelength of an electromagnetic wave whose frequency is given by:

$$f_w(a, b, N) = \frac{c}{L_w(a, b, N)} \tag{22}$$

In some cases, the measured resonant frequency was best predicted by either $0.75*f_w$(a,b,N) or $f_w$(a,b,2N). For example, at a frequency of 106 Mhz a linear half wave antenna would be 55.7" long assuming a velocity factor of 1.0 whereas a toroid design embracing the invention would have the following dimensions.

a=2.738"

b=0.563"

N=16 turns #16 wire m=4 segments

For this embodiment of the toroidal design, equations (2), (6) and (7) predict a resonant frequency of 311.5 MHz and $V_g$=0.454 for N=16 and 166.7 MHz for N=32. At the measured operating frequency, $V_g$=0.154 and for equation (4) to hold, the effective value of N must be 51 turns, which is a factor of 3.2 larger than the actual value for each conductor. In this case, $f_w$(a,b,2N)=103.2 MHz.

Figure 13:
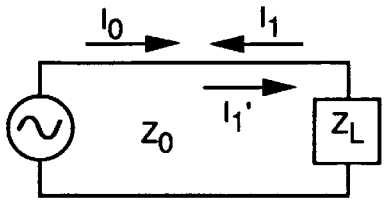
FIG. 13 PRIOR ART
FIG. 13 is an equivalent circuit for a terminated transmission line.

In a variation on the invention shown in FIG. 5, the connections at the two ports a and c to the input signal are broken, as are the conductors at the corresponding nodes. The remaining four open ports a11–a21, a12–a22, c11–c21 and c21–c22 are then terminated with a reactance Z whose impedance is matched to the intrinsic impedance of the transmission line segments formed by the contrawound toroidal helical conductor pairs. The signal reflections from these terminal reactances act (see FIG. 13) to reflect a signal which is in phase quadrature to the incident signals, such than the current distributions on the toroidal helical conductor are similar to those of the embodiment of FIG. 1, thus providing the same radiation pattern but with fewer feed connections between the signal terminals and the signal ports which simplifies the adjustment and tuning of the antenna structure.

Figure 14:
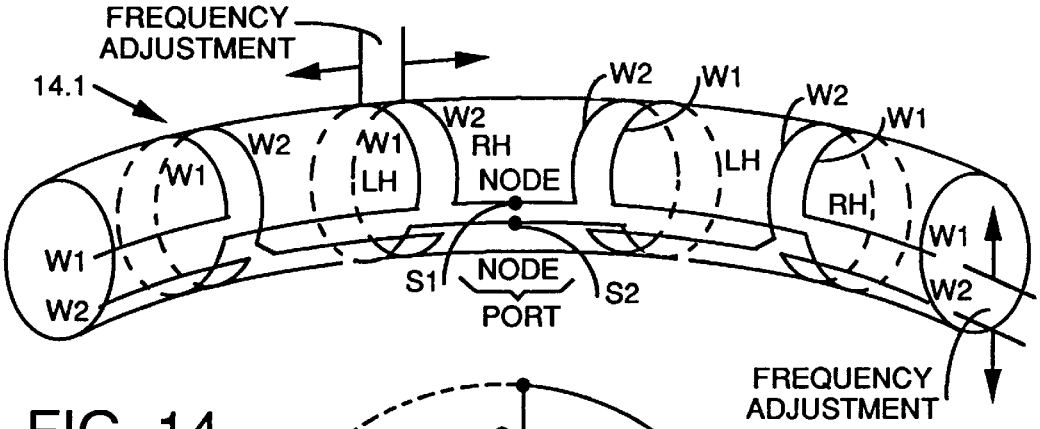
FIG. 14 is an enlarged view of poloidal windings on a toroid according to the present invention for tuning capability, improved electric field cancellation and simplified construction.

The toroidal contrawound conductors may be arranged in other than a helical fashion and still satisfy the spirit of this invention. FIG. 14 shows one such alternate arrangement (a "poloidal-peripheral winding pattern"), whereby the helix formed by each of the two insulated conductors W1. W2 is decomposed into a series of interconnected poloidal loops 14.1. The interconnections form circular arcs relative to the major axis. The two separate conductors are everywhere parallel, enabling this arrangement to provide a more exact cancellation of the toroidal electric current components and more precisely directing the magnetic current components created by the poloidal loops. This embodiment is characterized by a greater interconductor capacitance which acts to lower the resonant frequency of the structure as experimentally verified. The resonant frequency of this embodiment may be adjusted by adjusting the spacing between the parallel conductors W1 and W2, by adjusting the relative angle of the two contrawound conductors with respect to each other and with respect to either the major or minor axis of the torus.

Figure 15:
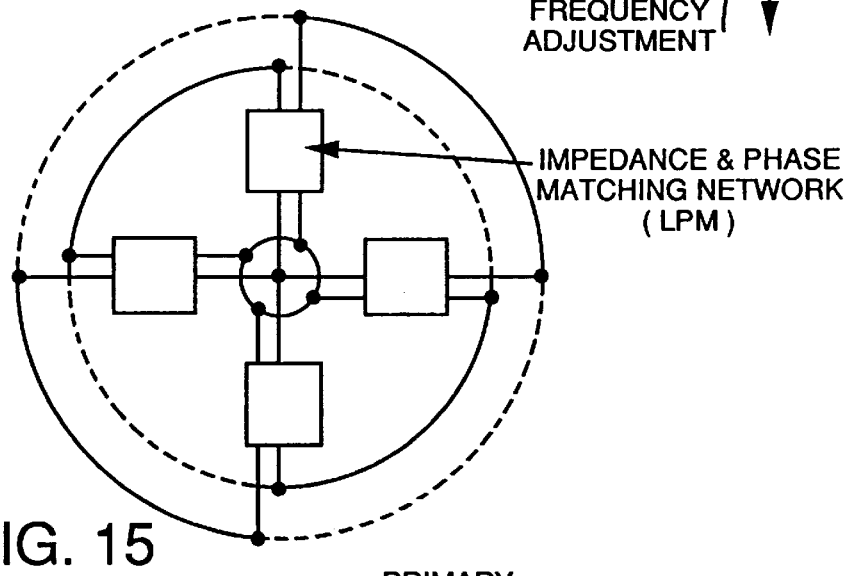
FIG. 15 is a simplified block diagram of a four quadrant version of an antenna embodying the present invention with impedance and phase matching elements.
Figure 16:
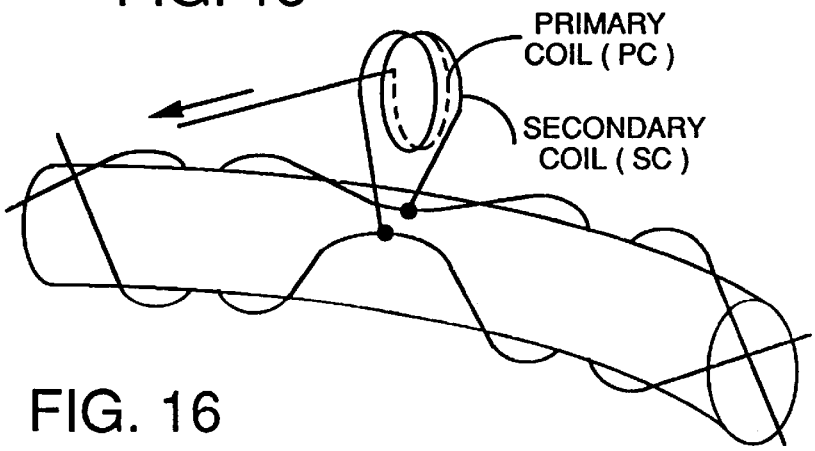
FIG. 16 is an enlargement of the windings of an antenna embodying the invention with primary and secondary impedance matching coils connecting the windings.

The signals at each of the signal ports S1, S2 should be balanced with respect to one another (i.e. equal magnitude with uniform 180° phase difference) magnitude and phase in order to carry out the invention in the best mode. The signal feed transmission line segments should also be matched at both ends, i.e. at the signal terminal common junction and at each of the individual signal ports on the contrawound toroidal helical structure. Imperfections in the contrawound windings, in the shape of the form upon which they are wound, or in other factors may cause variations in impedance at the signal ports. Such variations may require compensation such as in the form illustrated in FIG. 15 so that the currents entering the antenna structure are of balanced magnitude and phase so as to enable the most complete cancellation of the toroidal electric current components as described below. In the simplest form, if the impedance at the signal terminals is $Z_0$, typically 50 Ohms, and the signal impedance at the signal ports were a value of $Z_1$–m*$Z_0$, then the invention would be carried out with m feed lines each of equal length and of impedance $Z_1$ such that the parallel combination of these impedances at the signal terminal was a value of $Z_0$. If the impedance at the signal terminals were a resistive value $Z_1$ different from above, the invention could be carried out with quarter wave transformer feed lines, each one quarter wavelength long, and having an intrinsic impedance of $Z_f$=$Z_0$ $Z_1$. In general, any impedances could be matched with double stub tuners constructed from transmission line elements. The feed lines from the signal terminal could be inductively coupled to the signal ports as shown in FIG. 16. In addition to enabling the impedance of the signal ports to be matched to the feed line, this technique also acts as a balun to convert an unbalanced signal at the feed terminal to a balanced signal at the signal ports on the contrawound toroidal helical structure. With this inductive coupling approach, the coupling coefficient between the signal feed and the antenna structure may be adjusted so as to enable the antenna structure to resonate freely. Other means of impedance, phase, and amplitude matching and balancing familiar to those skilled in the art are also possible without departing from the spirit of this invention.

Figure 17:
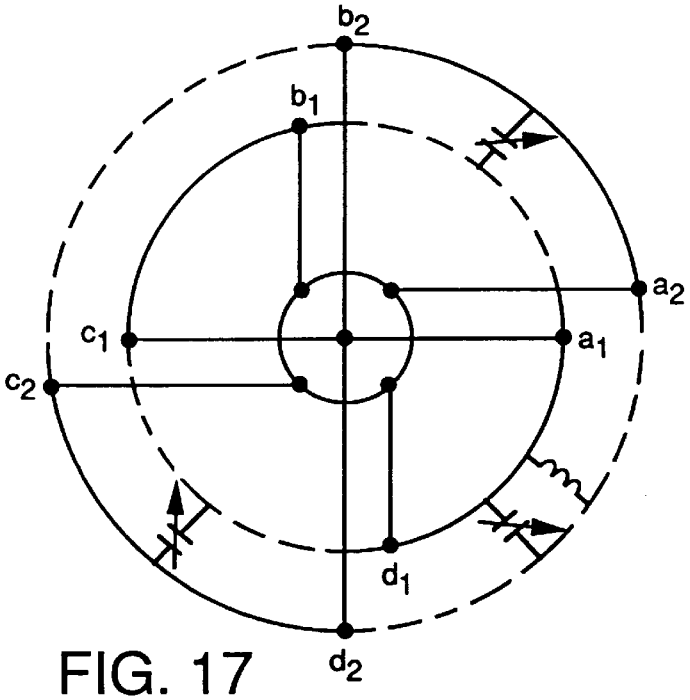
FIG. 17 is an equivalent circuit for an antenna embodying the invention illustrating a means of tuning.
Figure 18:
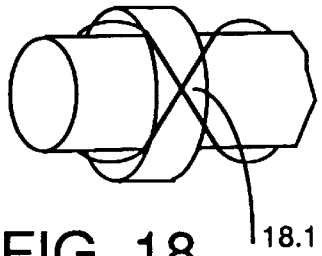
FIGS. 18 and 19 are schematics of a portion of a toroidal antenna using closed metal foil tuning elements around the toroid for purposes of tuning as in FIG. 17.
Figure 19:
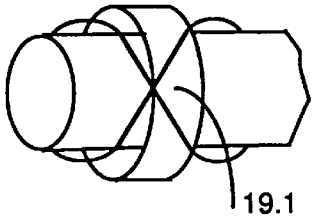
Figure 20:
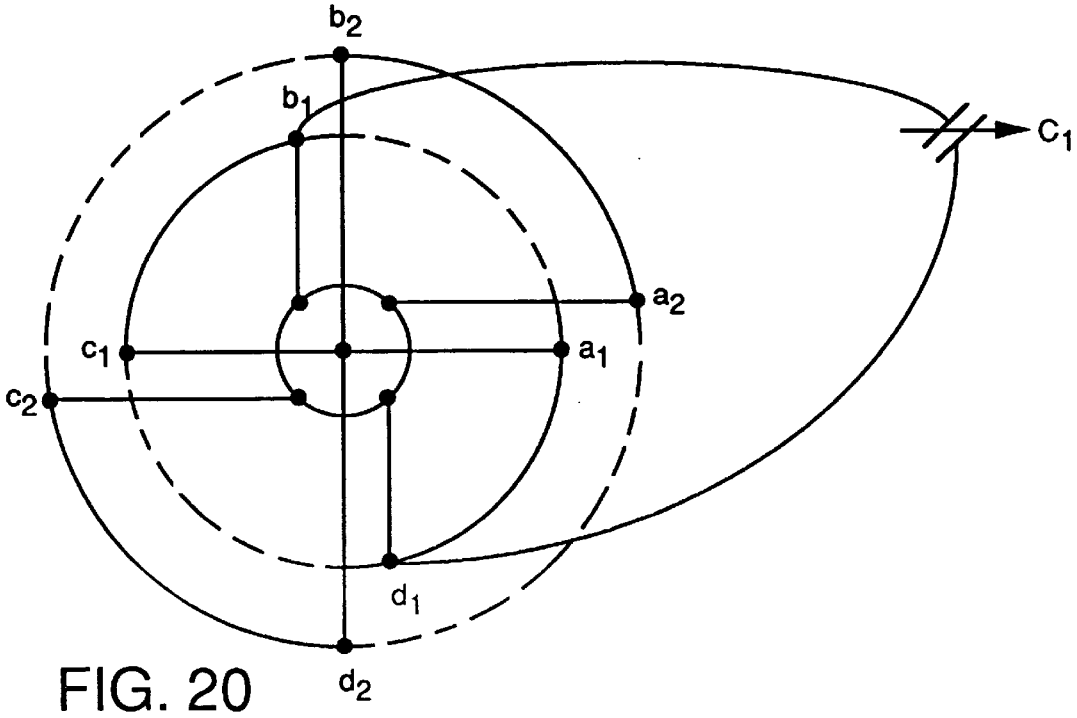
FIG. 20 is a schematic showing an antenna embodying the present invention using a tuning capacitor between opposed nodes.
Figure 21:
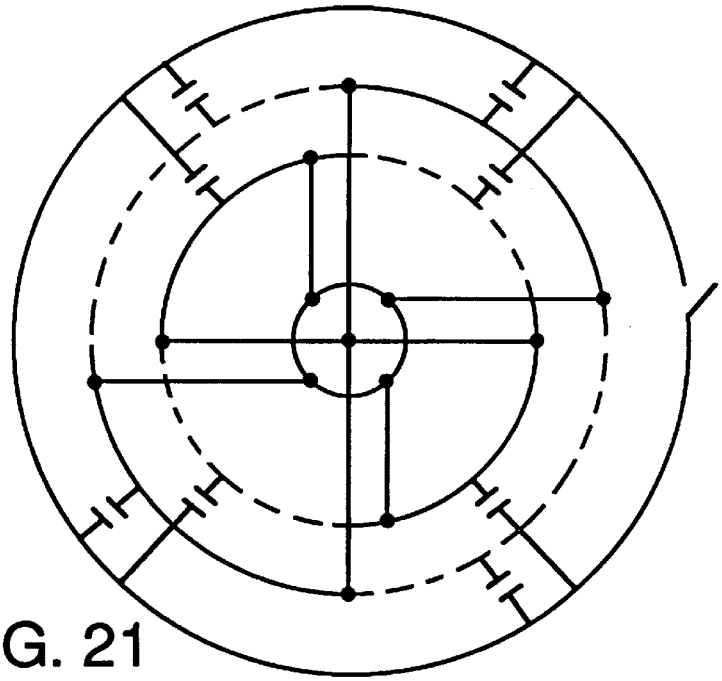
FIG. 21 is an equivalent circuit of an alternate tuning method for of a quadrant antenna embodying the present invention.
Figure 22:
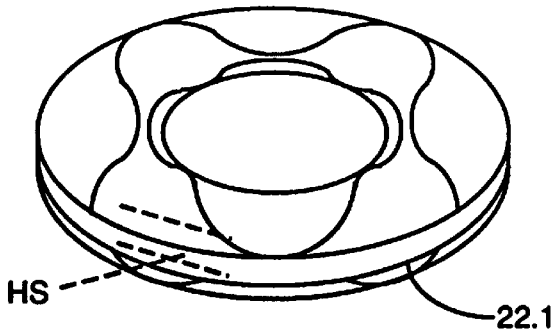
FIG. 22 shows an antenna according to the present invention with a conductive foil wrapper on the toroid for purposes of tuning as in FIG. 21.
Figure 23:
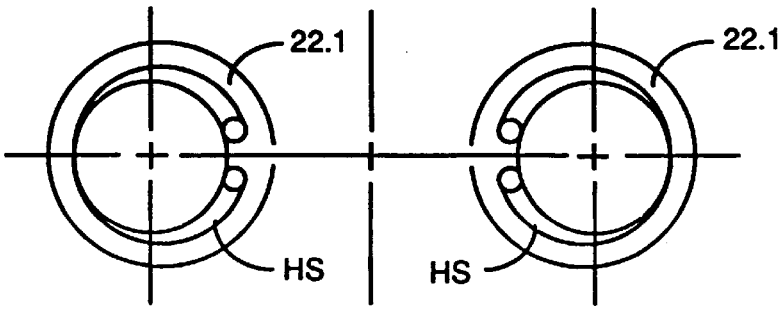
FIG. 23 is a section along line 23—23 in FIG. 24.
Figure 25:
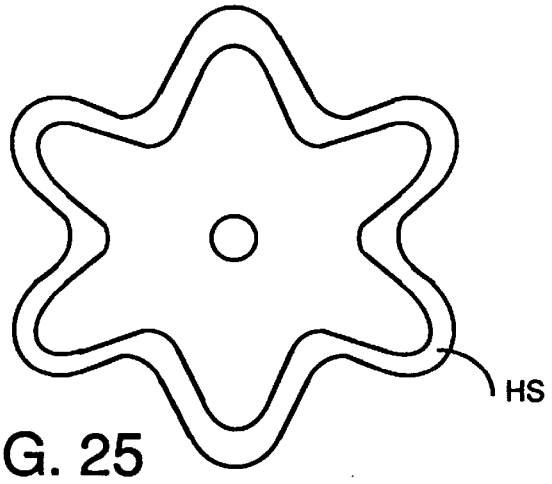
FIG. 25 shows an alternate embodiment of an antenna with "rotational symmetry" embodying the present invention.

The antenna structure may be tuned in a variety of manners. In the best mode, the means of tuning should be uniformly distributed around the structure so as to maintain a uniform azimuthal magnetic ring current. FIG. 17 illustrates the use of poloidal foil structures 18.1, 19.1 (see FIGS. 18 and 19) surrounding the two insulating conductors which act to modify the capacitive coupling between the two helical conductors. The poloidal tuning elements may either be open or closed loops, the latter providing an additional inductive coupling component. FIG. 20 illustrates a means of balancing the signals on the antenna structure by capacitively coupling different nodes, and in particular diametrically opposed nodes on the same conductor. The capacitive coupling, using a variable capacitor C1, may be azimuthally continuous by use of a circular conductive foil or mesh, either continuous or segmented, which is parallel to the surface of the toroidal form and of toroidal extent. The embodiments in FIGS. 23 and 25 result from the extension of the embodiments of either FIGS. 17–21, wherein the entire toroidal helical structure HS is surrounded by a shield 22.1 which is everywhere concentric. Ideally, the toroidal helical structure HS produces strictly toroidal magnetic fields which are parallel to such a shield, so that for a sufficiently thin foil for a given conductivity and operating frequency, the electromagnetic boundary conditions are satisfied enabling propagation of the electromagnetic field outside the structure. A slot (poloidal) 25.1 may be added for tuning as explained herein.

Figure 26:
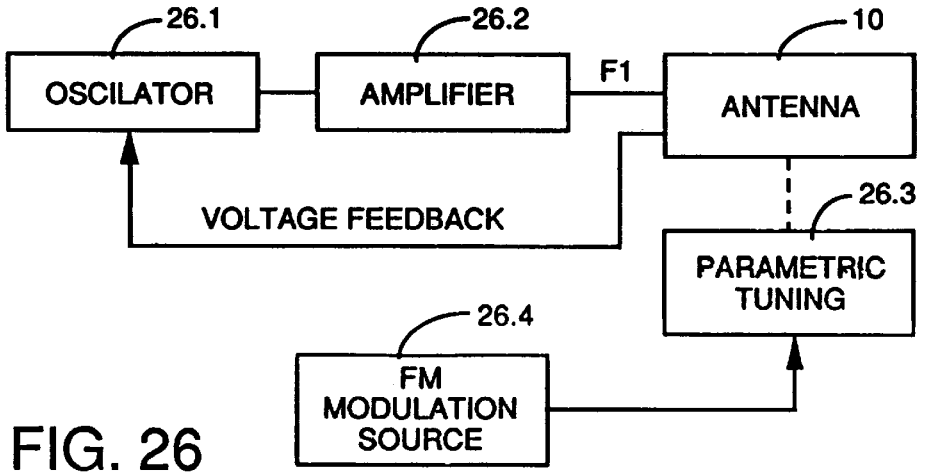
FIG. 26 is a functional block diagram of an FM transmitter using a modulator controlled parametric tuning device on an antenna.

The contrawound toroidal helical antenna structure is a relatively high Q resonator which can serve as a combined tuning element and radiator for an FM transmitter as shown in FIG. 26 having an oscillator amplifier 26.2 to receive a voltage from the antenna 10. Through a parametric tuning element 26.3 controlled by a modulator 26.4, modulation may be accomplished. The transmission frequency F1 is controlled by electronic adjustment of a capacitive or inductive tuning element attached to the antenna structure by either direct modification of reactance or by switching a series fixed reactive elements (discussed previously) so as to control the reactance which is coupled to the structure, and hence adjust the natural frequency of the contrawound toroidal helical structure.

Figure 27:
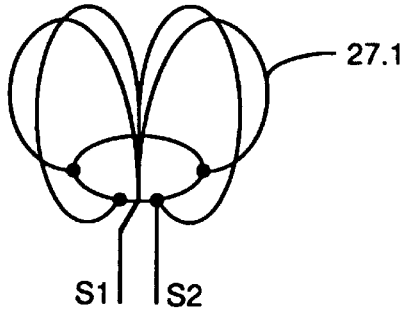
FIG. 27 shows an omnidirectional poloidal loop antenna.
Figure 28:
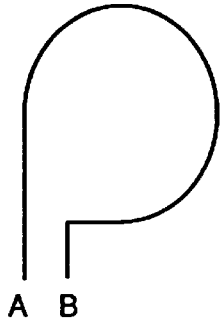
FIG. 28 is a side view of one loop in the antenna shown in FIG. 27.
Figure 29:
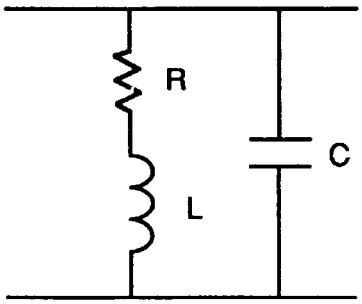
FIG. 29 is an equivalent circuit for the loop antenna.
Figure 30:
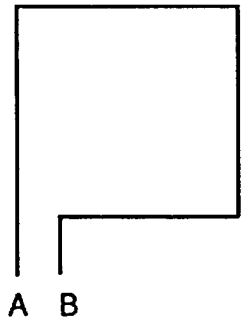
FIG. 30 is a side view of a square loop antenna.
Figure 33:
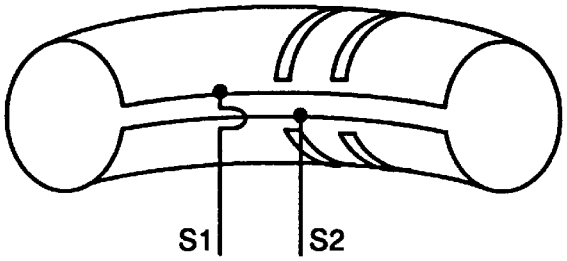
FIG. 33 is a partial view of a toroid with toroid slots for tuning and for emulation of a poloidal loop configuration according to the present invention.

In another variation of the invention shown in FIG. 27, the toroidal helical conductors of the previous embodiments are replaced by a series of N poloidal loops 27.1 uniformly azimuthally spaced about a toroidal form. The center most portions of each loop relative to the major radius of the torus are connected together at the signal terminal S1, while the remaining outer most portions of each loop are connected together at signal terminal S2. The individual loops while identical with one another may be of arbitrary shape, with FIG. 28 illustrating a circular shape, and FIG. 30 illustrating a rectangular shape. The electrical equivalent circuit for this configuration is shown in FIG. 29. The individual loop segments each act as a conventional loop antenna. In the composite structure, the individual loops are fed in parallel so that the resulting magnetic field components created thereby in each loop are in phase and azimuthally directed relative to the toroidal form resulting in an azimuthally uniform ring of magnetic current. By comparison, in the contrawound toroidal helical antenna, the fields from the toroidal components of the contrawound helical conductors are canceled as if these components did not exist, leaving only the contributions from the poloidal components of the conductors. The embodiment of FIG. 27 thus eliminates the toroidal components from the physical structure rather than rely on cancellation of the correspondingly generated electromagnetic fields. Increasing the number of poloidal loops in the embodiment of FIG. 27 results in the embodiments of FIGS. 31 and 33 for loops of rectangular and circular profile respectively. The individual loops become continuous conductive surfaces, which may or may not have radial plane slots so as to emulate a multi-loop embodiment. These structures create azimuthal magnetic ring currents which are everywhere parallel to the conductive toroidal surface, and whose corresponding electric fields are everywhere perpendicular to the conductive toroidal surface. Thus the electromagnetic waves created by this structure can propagate through the conductive surface given that the surface is sufficiently thin for the case of a continuous conductor. This device will have the effect of a ring of electric dipoles in moving charge between the top and bottom sides of the structure, i.e. parallel to the direction of the major axis of the toroidal form.

Figure 31:
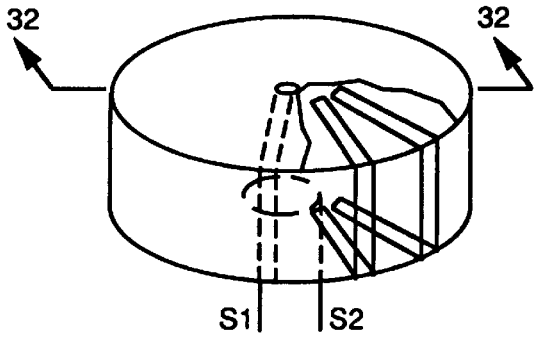
FIG. 31 is a partial cutaway view of cylindrical loop antenna according to the invention.
Figure 32:
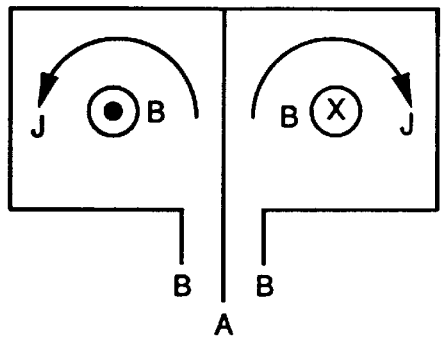
FIG. 32 is a section along 32—32 in FIG. 31 and includes a diagram of the current in the windings.
Figure 34:
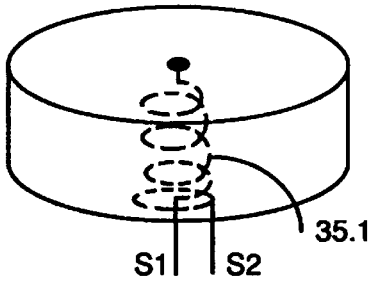
FIG. 34 shows a toroidal antenna with a toroid core tuning circuit.
Figure 35:
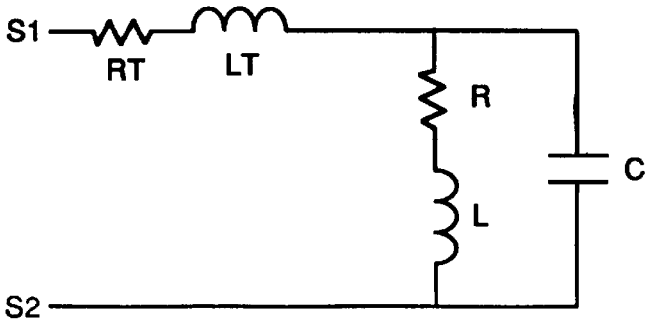
FIG. 35 is an equivalent circuit for the antenna shown in FIG. 34.
Figure 36:
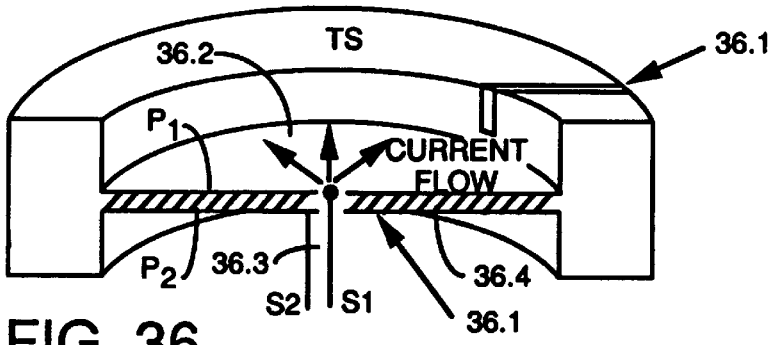
FIG. 36 is a cutaway of a toroidal antenna with a central capacitance tuning arrangement according to the present invention.

The embodiments of FIGS. 27 and 31 share the disadvantage of relatively large size because of the necessity for the loop circumference to be on the order of one half wavelength for resonant operation. However, the loop size may be reduced by adding either series inductance or parallel reactance to the structures of FIGS. 27 and 31. FIG. 34 illustrates the addition of series inductance by forming the central conductor of the embodiment of FIG. 31 into a solenoidal inductor 35.1. FIG. 36 illustrates the addition of parallel capacitance 36.1 to the embodiment of FIG. 31. The parallel capacitor is in the form of a central hub 36.2 for the toroid structure TS which also serves to provide mechanical support for both the toroidal form and for the central electrical connector 36.3 by which the signal at terminals S1 and S2 is fed to the antenna structure. The parallel capacitor and structural hub are formed from two conductive plates P1 and P2, made from copper, aluminum or some other nonferrous conductor, and separated by a medium such as air, Teflon, polyethylene or other low loss dielectric material 36.4. The connector 36.3 with terminals S1 and S2 is conductively attached to and at the center of parallel plates P1 and P2 respectively, which are in turn conductively attached to the respective sides of a toroidal slot on the interior of the conductive toroidal surface TS. The signal current flows radially outward from connector 36.3 through plates P1 and P2 and around the conductive toroidal surface TS. The addition of the capacitance provided by conductive plates P1 and P2 enables the poloidal circumference of the toroidal surface TS to be significantly smaller than would otherwise be required for a similar state of resonance by a loop antenna operating at the same frequency.

Figure 38:
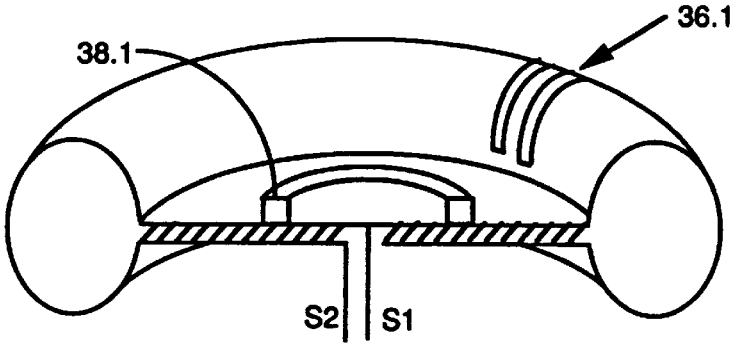
FIG. 38 is an alternate embodiment with variable capacitance tuning.
Figure 37:
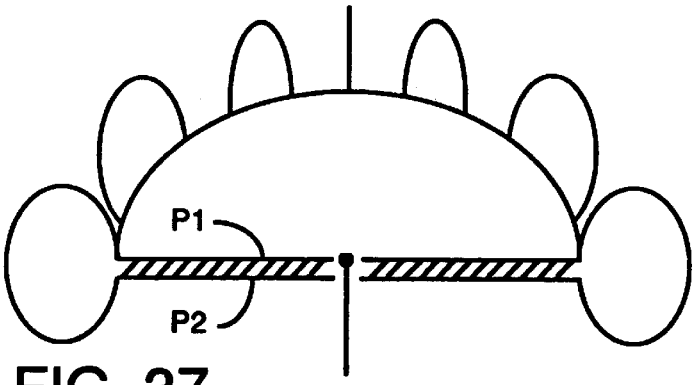
FIG. 37 is a cutaway of an alternate embodiment of the antenna shown in FIG. 36 with poloidal windings.

The capacitive tuning element of FIG. 36 may be combined with the inductive loops of FIG. 27 to form the embodiment of FIG. 37, the design of which can be illustrated by assuming for the equivalent circuit of FIG. 38 that all of the capacitance in the is provided by the parallel plate capacitor, and all of the inductance is provided by the wire loops. The formulas for the capacitance of a parallel plate capacitor and for a wire inductor are given in the reference *Reference Data for Radio Engineers, 7th ed.,* E. C. Jordan ed., 1986, Howard W. Sams, p. 6–13 as:

$$C = 0.225\varepsilon_r\left[(N-1)\frac{A}{t}\right]$$

and $$L_{wire} = \frac{a}{100}\left[7.353\,\mathrm{Log}_{10}\left(16\frac{a}{d}\right) - 6.386\right] \tag{24}$$

where

C=capacitance pfd $L_{wire}$=inductance $\mu$H

A=plate area in$^2$ t=plate separation in.

N=number of plates a=mean radius of wire loop in.

d=wire diameter in.

$\epsilon_r$=relative dielectric constant

The resonant frequency of the equivalent parallel circuit, assuming a total of N wires, is then given by:

$$\omega = \frac{1}{\sqrt{L_{total}C}} = \frac{1}{\sqrt{\frac{L_{wire}}{N}C}} \tag{25}$$

$$f = \frac{\omega}{2\pi} \tag{26}$$

For a toroidal form with a minor diameter=2.755 in. and a major inside diameter (diameter of capacitor plates) of 4.046 in. for N=24 loops of 16 gauge wire (d=0.063 in.) with a plate separation of t=0.141 in. gives a calculated resonant frequency of 156.5 MHz.

For the embodiment of FIG. 38, the inductance of a single turn toroidal loops is approximated by:

$$L = \frac{\mu_0 b^2}{2a} \tag{27}$$

where $\mu_0$ is the permeability of free space=400 π nH/m, and a and b are the major and minor radius of the toroidal form respectively. The capacitance of the parallel plate capacitor formed as the hub of the torus is given by:

$$C = \varepsilon_0\varepsilon_r\frac{A}{t} = \varepsilon_0\varepsilon_r\frac{\pi(a-b)^2}{t} \tag{28}$$

here $\epsilon_0$ is the permitivity of free space=8.854 pfd./m.

Substituting equations (27) and (28) into equations (25) and (26) gives:

$$f = \frac{38.07}{\sqrt{\frac{b^2(a-b)^2\varepsilon_r}{at}}}\,\mathrm{MHz} \tag{29}$$

Equation (29) predicts that the toroidal configuration illustrated above except for a continuous conductive surface will have the same resonant frequency of 156.5 MHz if the plate separation is increased to 0.397 in.

The embodiments of FIGS. 36, 37 and 38 can be tuned by adjusting either the entire plate separations, or the separation of a relatively narrow annular slot from the plate as shown in FIG. 38, where this fine tuning means is azimuthally symmetric so as to preserve symmetry in the signals which propagate radially outward from the center of the structure.

Figure 24:
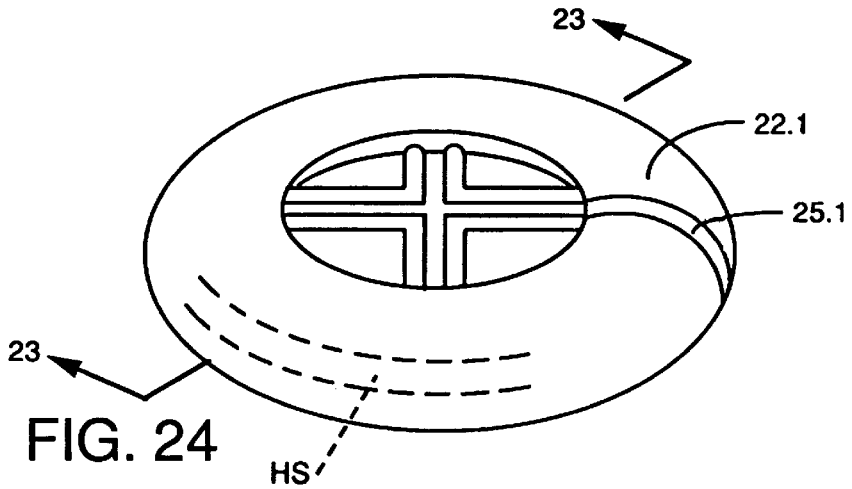
FIG. 24 is a perspective view of a foil covered antenna according to the present invention.
Figure 39:
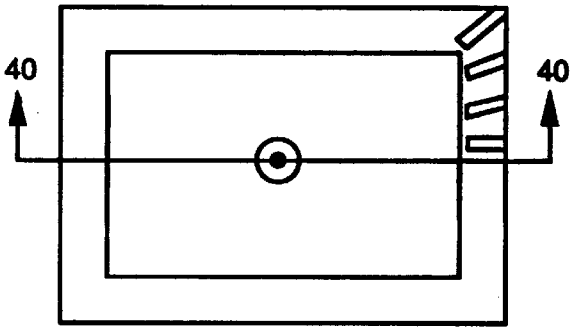
FIG. 39 is a plan view of a square toroidal antenna according to the present invention for augmenting antenna bandwidth and with slots for tuning or for emulation of a poloidal loop configuration.
Figure 40:
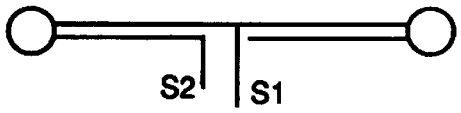
FIG. 40 is a section along 40—40 in FIG. 39.
Figure 41:
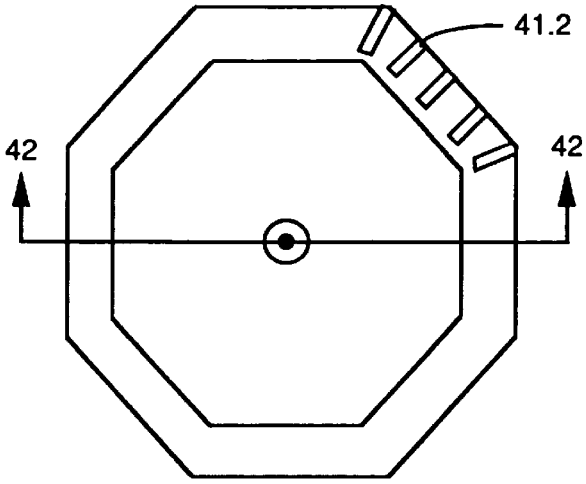
FIG. 41 is a plan view of an alternate embodiment of the antenna shown in FIG. 39 having six sides with slots for tuning or for emulation of a poloidal configuration.
Figure 42:
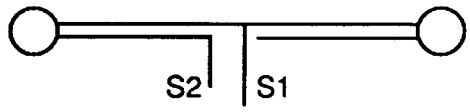
FIG. 42 is a section along 42—42 in FIG. 41.

FIGS. 39 and 41 illustrate means of increasing the bandwidth of this antenna structure. Since the signals propagate outward in a radial direction, the bandwidth is increased by providing different differential resonant circuits in different radial directions. The variation in the geometry is made azimuthally symmetric so as to minimize geometric perturbation to the azimuthal magnetic field. FIGS. 39 and 41 illustrate geometrics which are readily formed from commercially available tubing fittings, while FIG. 25 (or FIG. 24) illustrates a geometry with a sinusoidally varying radius which would reduce geometric perturbations to the magnetic field.

Figure 43:
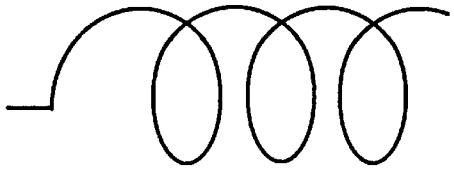
FIG. 43 PRIOR ART
FIG. 43 is a conventional linear helix.
Figure 44:
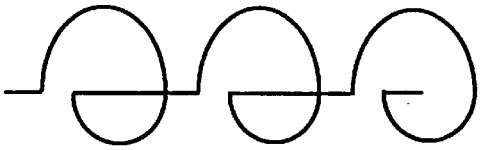
FIG. 44 PRIOR ART
FIG. 44 is an approximate linear helix.
Figure 45:
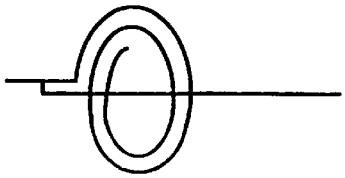
FIG. 45 is a composite equivalent of the configuration shown in FIG. 45 assuming that the magnetic field is uniform or quasi uniform over the length of the helix.
Figure 46:
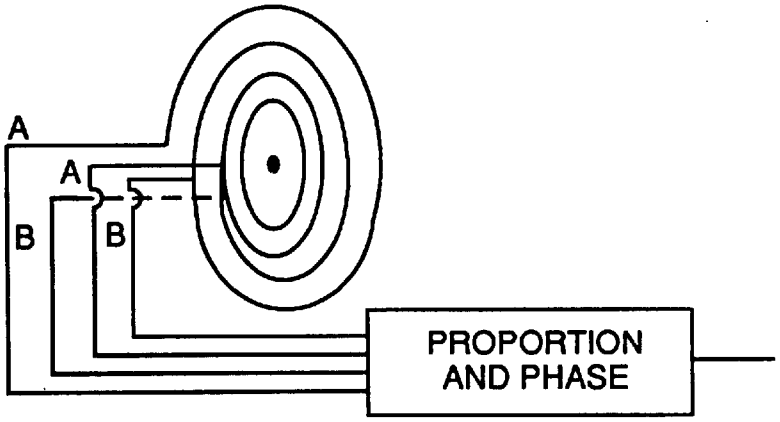
FIG. 46 shows a contrawound toroidal helical antenna with an external loop and a phase shift and proportional control.
Figure 47:
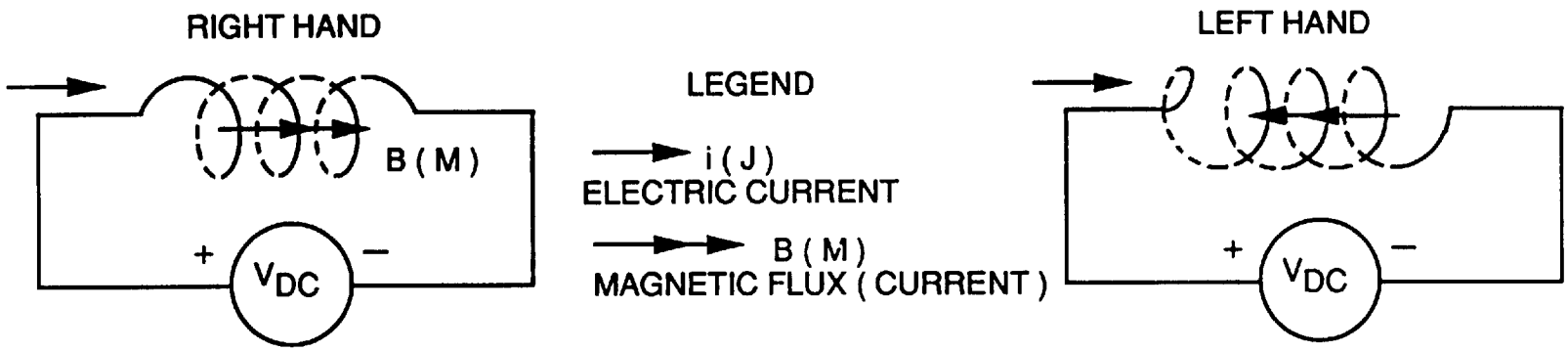
FIG. 47 PRIOR ART
FIG. 47 shows right hand sense and left hand sense equivalent circuits and associated electric and magnetic fields.

The prior art of helical antennas show their application in remote sensing of geotechnical features and for navigation therefrom. For this application, relatively low frequencies are utilized necessitating large structures for good performance. The linear helical antenna is illustrated in FIG. 43. This can be approximated by FIG. 44 where the true helix is decomposed in to a series of single turn loops separated by linear interconnections. If the magnetic field were uniform or quasi-uniform over the length of this structure, then the loop elements could be separated from the composite linear element to form the structure of FIG. 45. This structure can be further compressed in size by then substituting for the linear element either the toroidal helical or the toroidal poloidal antenna structures described herein, as illustrated in FIG. 46. The primary advantage to this configuration is that the overall structure is more compact than the corresponding linear helix which is advantageous for portable applications as in air, land or sea vehicles, or for inconspicuous applications. A second advantage to this configuration, and to that of FIG. 45 is that the magnetic field and electric field signal components are decomposed enabling them to be subsequently processed and recombined in a manner different from that inherent to the linear helix but which can provide additional information.

Referring to FIG. 48, a schematic of an electromagnetic antenna 48 is illustrated. The antenna 48 includes a multiply connected surface such as the toroid form TF of FIG. 1, an insulated conductor circuit 50, and two signal terminals 52,54.

As employed herein the term "multiply connected surface" shall expressly include, but not be limited to: (a) any toroidal surface such as the preferred toroid form TF having its major radius greater than or equal to its minor radius; (b) other surfaces formed by rotating a plane closed curve or polygon having a plurality of different radii about an axis lying on its plane, with such other surfaces' major radius being greater than or equal to its maximum minor radius; and (c) still other surfaces such as surfaces like those of a washer or nut such as a hex nut formed from a generally planar material in order to define, with respect to its plane, an inside circumference greater than zero and an outside circumference greater than the inside circumference, with the outside and inside circumferences being either a plane closed curve and/or a polygon.

The exemplary insulated conductor circuit 50 extends in a conductive path 56 around and over the toroid form TF of FIG. 1 from a node 60 (+) to another node 62 (−). The insulated conductor circuit 50 also extends in another conductive path 58 around and over the toroid form TF from the node 62 (−) to the node 60 (+) thereby forming a single endless conductive path around and over the toroid form TF.

As discussed above in connection with FIG. 1, the conductive paths 56,58 may be contrawound helical conductive paths having the same number of turns, with the helical pitch sense for the conductive path 56 being right hand (RH), as shown by the solid line, and the helical pitch sense for the conductive path 58 being left hand (LH) which is opposite from the RH pitch sense, as shown by the broken lines.

The conductive paths 56,58 may be arranged in other than a helical fashion, such as a generally helical fashion or a spiral fashion, and still satisfy the spirit of this invention. The conductive paths 56,58 may be contrawound "poloidal-peripheral winding patterns" having opposite winding senses, as discussed above in connection with FIG. 14, whereby the helix formed by each of the two insulated conductors W1, W2 is decomposed into a series of interconnected poloidal loops 14.1.

Continuing to refer to FIG. 48, the conductive paths 56,58 reverse sense at the nodes 60,62. The signal terminals 52,54 are respectively electrically connected to the nodes 60,62. The signal terminals 52,54 either supply to or receive from the insulated conductor circuit 50 an outgoing (transmitted) or incoming (received) RF electrical signal 64. For example, in the case of a transmitted signal, the single endless conductive path of the insulated conductor circuit 50 is fed in series from the signal terminals 52,54.

It will be appreciated by those skilled in the art that the conductive paths 56,58 may be formed by a single insulated conductor, such as, for example, a wire or printed circuit conductor, which forms the single endless conductive path including the conductive path 56 from the node 60 to the node 62 and the conductive path 58 from the node 62 back to the node 60. It will be further appreciated by those skilled in the art that the conductive paths 56,58 may be formed by plural insulated conductors such as one insulated conductor which forms the conductive path 56 from the node 60 to the node 62, and another insulated conductor which forms the conductive path 58 from the node 62 back to the node 60.

Also referring to FIGS. 49–51, current and magnetic field plots relative to the nodes 60,62 of the antenna 48 are illustrated. As similarly discussed above in connection with FIGS. 7–12, the currents in the conductive paths 56,58 of FIG. 48 are 180 degrees out of phase. The current distributions are referenced in these plots to the nodes 60,62, where J refers to electric current, M refers to magnetic current, CW refers to clockwise, and CCW refers to counter-clockwise. This analysis assumes that the nominal operating frequency of the signal 64 is tuned to the structure of the antenna 48 in order that the electrical circumference thereof is one-half wavelength in length, and that the current distribution on the structure is sinusoidal in magnitude, which is an approximation. The contrawound conductive paths 56,58, which each have a length of about one-half of a guided wavelength of the nominal operating frequency, may be viewed as elements of a non-uniform transmission line with a balanced feed. The paths 56,58 form a closed loop that has been twisted to form a "figure-8" and then folded back on itself to form two concentric windings.

In order to enhance the understanding of the embodiment of FIGS. 48–51, an example will be provided.

EXAMPLE

At a nominal operating frequency of 30.75 MHz, for example, a linear half wave antenna (not shown) would be about 192.0" long assuming a velocity factor of 1.0. In contrast, at the exemplary nominal operating frequency of 30.75 MHz, the electromagnetic antenna 48, using the toroid form TF of FIG. 1, would have the following characteristics:

a=11.22" major radius b=0.52" minor radius

N=36 turns #16 wire in each of the conductive paths 56,58 m=2 conductive paths 56,58.

The plot of FIG. 49 shows the electric current distribution with polarity referenced to the direction of propagation away from the nodes 60,62 from which the signals emanate. The plot of FIG. 50 shows the same current distribution when referenced to a common counter-clockwise direction, recognizing that the polarity of the current changes with respect to the direction to which it is referenced. FIG. 51 illustrates the corresponding magnetic current distribution utilizing the principles illustrated above in connection with FIG. 1. FIG. 50 shows that the net electric current distribution on the toroid form TF of FIG. 1 is canceled, and FIG. 51 shows that the net magnetic current distribution is enhanced.

In this manner, the conductive path 56 conducts electric currents $CCW_1J$, $CW_1J$ therein and conductive path 58 conducts electric currents $CCW_2J$, $CW_2J$ therein. These conductive paths 56,58 and the associated electric currents produce corresponding clockwise and counter-clockwise magnetic currents, such as the magnetic currents $CCW_1M$, $CCW_2M$ produced by the respective conductive paths 56,58 and respective electric currents $CCW_1J$, $CCW_2J$ therein. FIG. 50, with the current distribution referenced to the CCW direction, illustrates destructive interference of the currents $CCW_1J$, $CCW_2J$. Similarly, FIG. 51, with the current distribution referenced to the CCW direction, illustrates constructive interference of the magnetic currents $CCW_1M$, $CCW_2M$.

A method of transmitting an RF signal, such as the signal 64, with the exemplary antenna 48 of FIG. 48 includes applying the RF signal 64 to the signal terminals 52,54 in order to induce electric currents $CCW_1J$, $CW_1J$, $CCW_2J$, $CW_2J$ of the RF signal 64 therebetween; conducting the electric currents $CCW_1J$, $CW_1J$ in the conductive path 56; conducting the electric currents $CCW_2J$, $CW_2J$ in the conductive path 58; and employing the conductive paths 56,58 in a contrawound relationship to each other.

Referring to FIG. 52, a schematic of another electromagnetic antenna 48' is illustrated. The antenna 48' includes a multiply connected surface such as the toroid form TF of FIG. 1, an insulated conductor circuit 50', and two signal terminals 52',54'. Except as discussed herein, the electromagnetic antenna 48', insulated conductor circuit 50', and signal terminals 52',54'are generally the same as the respective electromagnetic antenna 48, insulated conductor circuit 50, and signal terminals 52,54 of FIG. 48.

The exemplary insulated conductor circuit 50' extends in a conductive path 56' around and over the toroid form TF of FIG. 1 from a node 60' (+) to an intermediate node A and from the intermediate node A to another node 62' (−). The insulated conductor circuit 50' also extends in another conductive path 58' around and over the toroid form TF from the node 62' (−) to another intermediate node B and from the intermediate node B to the node 60' (+) thereby forming a single endless conductive path around and over the toroid form TF.

As discussed above in connection with FIGS. 14 and 48, the conductive paths 56',58' may be contrawound helical conductive paths having the same number of turns or may be arranged in other than a purely helical fashion such as contrawound "poloidal-peripheral winding patterns" having opposite winding senses.

The signal terminals 52',54' either supply to or receive from the insulated conductor circuit 50' an outgoing (transmitted) or incoming (received) RF electrical signal 64. The conductive paths 56',58', which each have a length of about one-half of a guided wavelength of the nominal operating frequency of the signal 64, reverse sense at the nodes 60',62'. The signal terminals 52',54' are respectively electrically connected to the intermediate nodes A,B. Preferably, the nodes 60',62' are diametrically opposed to the intermediate nodes A,B in order that the length of the conductive paths 56',58' from the respective nodes 60',62' to the respective intermediate nodes A,B is the same as the length of the conductive paths 56',58' from the respective intermediate nodes A,B to the respective nodes 62',60'.

It will be appreciated by those skilled in the art that the conductive paths 56',58' may be formed by a single insulated conductor which forms the single endless conductive path including the conductive path 56' from the node 60' to the intermediate node A and then to the node 62', and the conductive path 58' from the node 62' to the intermediate node B and then to the node 60'. It will be further appreciated by those skilled in the art that each of the conductive paths 56',58' may be formed by one or more insulated conductors such as, for example, one insulated conductor from the node 60' to the intermediate node A and from the intermediate node A to the node 62'; or one insulated conductor from the node 60' to the intermediate node A, and another insulated conductor from the intermediate node A to the node 62'.

Referring to FIGS. 53–55, current and magnetic field plots, similar to the respective plots of FIGS. 49–51, relative to the nodes 60',A,B,62' of the antenna 48' of FIG. 52 are illustrated.

Referring to FIG. 56, a schematic of another electromagnetic antenna 66 is illustrated. The antenna 66 includes a multiply connected surface such as the toroid form TF of FIG. 1, a first insulated conductor circuit 68, a second insulated conductor circuit 70, and two signal terminals 72,74.

The insulated conductor circuit 68 includes a pair of generally helical conductive paths 76,78, and the insulated conductor circuit 70 similarly includes a pair of generally helical conductive paths 80,82. The insulated conductor circuit 68 extends in the conductive path 76 around and partially over the toroid form TF of FIG. 1 from a node 84 to a node 86, and also extends in the conductive path 78 around and partially over the toroid form TF from the node 86 to the node 84 in order that the conductive paths 76,78 form an endless conductive path around and substantially over the toroid form TF. The insulated conductor circuit 70 extends in the conductive path 80 around and partially over the toroid form TF from a node 88 to a node 90, and also extends in the conductive path 82 around and partially over the toroid form TF from the node 90 to the node 88 in order that the conductive paths 80,82 form another endless conductive path around and substantially over the toroid form TF.

As discussed above in connection with FIGS. 14 and 48, the conductive paths 76,78 and 80,82 may be contrawound helical conductive paths having the same number of turns or may be arranged in other than a purely helical fashion such as contrawound "poloidal-peripheral winding patterns" having opposite winding senses. For example, the pitch sense of the conductive path 76 may be right hand (RH), as shown by the solid line, the pitch sense for the conductive path 78 being left hand (LH) which is opposite from the RH pitch sense, as shown by the broken lines, and the pitch sense for the conductive paths 80 and 82 being LH and RH, respectively. The conductive paths 76,78 reverse sense at the nodes 84 and 86. The conductive paths 80,82 reverse sense at the nodes 88 and 90.

The signal terminals 72,74 either supply to or receive from the insulated conductor circuits 68,70 an outgoing (transmitted) or incoming (received) RF electrical signal 92. For example, in the case of a transmitted signal, the pair of endless conductive paths of the insulated conductor circuits 68,70 are fed in parallel from the signal terminals 72,74. Each of the conductive paths 76,78,80,82 have a length of about one-quarter of a guided wavelength of the nominal operating frequency of the signal 92. As shown in FIG. 56, the signal terminal 72 is electrically connected to the node 84 and the signal terminal 74 is electrically connected to the node 88.

It will be appreciated by those skilled in the art that the insulated conductor circuits 68,70 may each be formed by one or more insulated conductors. For example, the insulated conductor circuit 68 may have a single conductor for both of the conductive paths 76,78; a single conductor for each of the conductive paths 76,78; or multiple electrically interconnected conductors for each of the conductive paths 76,78.

Referring to FIGS. 57–59, current and magnetic field plots, similar to the respective plots of FIGS. 49–51, relative to the nodes 84,86,88,90 of the antenna 66 of FIG. 56 are illustrated. The plot of FIG. 58 shows the same current distribution when referenced to a common counterclockwise direction and the plot of FIG. 59 illustrates the corresponding magnetic current distribution.

Figure 60:
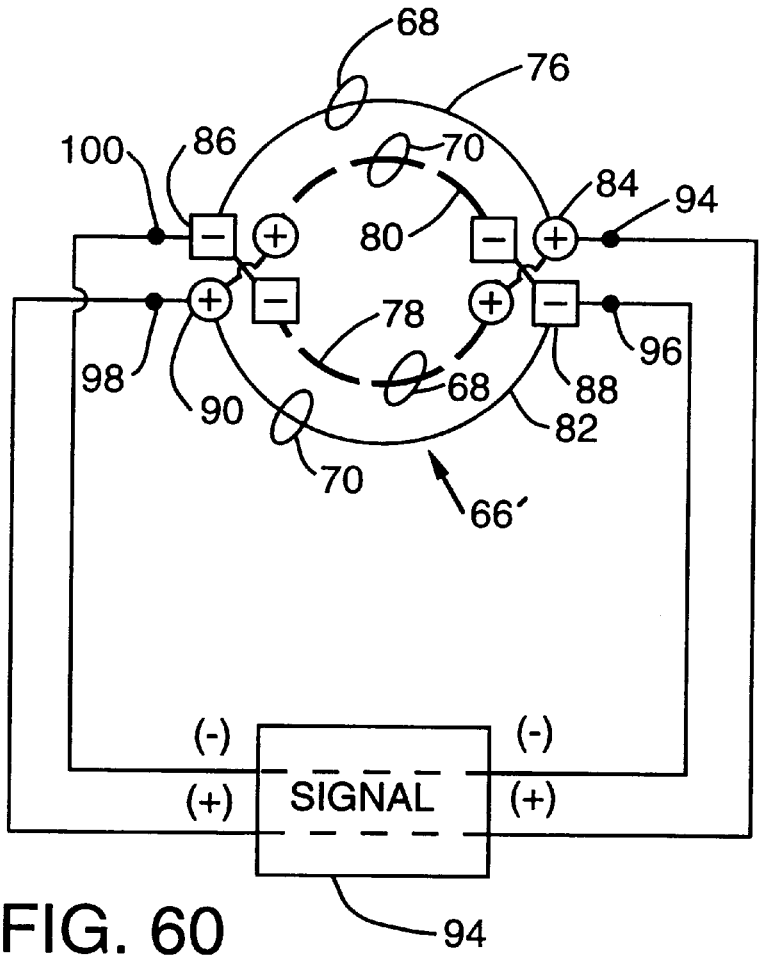
FIG. 60 is a schematic illustration of a parallel fed antenna according to another embodiment of the invention.

Referring to FIG. 60, a schematic of another electromagnetic antenna 66' is illustrated. Except as discussed herein, the electromagnetic antenna 66' is generally the same as the electromagnetic antenna 66 of FIG. 56. The electromagnetic antenna 66' includes signal terminals 94,96, which are similar to the respective signal terminals 72,74 of FIG. 56, and signal terminals 98,100. The signal terminal 98 is electrically connected to the node 90 and the signal terminal 100 is electrically connected to the node 86.

As shown in FIG. 60, pairs 94,96 and 98,100 of signal terminals 94,96,98,100 either supply to or receive from the insulated conductor circuits 68,70 an outgoing (transmitted) or incoming (received) RF electrical signal 94 which is electrically connected in parallel to the signal terminal pairs 94,96 and 98,100.

Figure 61:
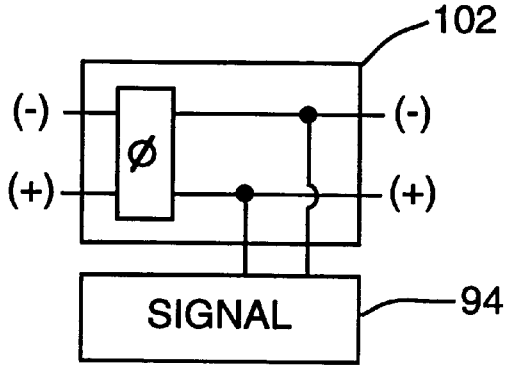
FIG. 61 is a block diagram of an interface for the antenna of FIG. 60 with an impedance and phase matching element according to another embodiment of the invention.

Alternatively, as shown in FIG. 61, an impedance and phase shifting network 102 may be employed between the signal 94 and one or both of the pairs 94,96 and 98,100 of FIG. 60. Other means of impedance, phase, and amplitude matching and balancing familiar to those skilled in the art are also possible without departing from the spirit of this invention.

Figure 62:
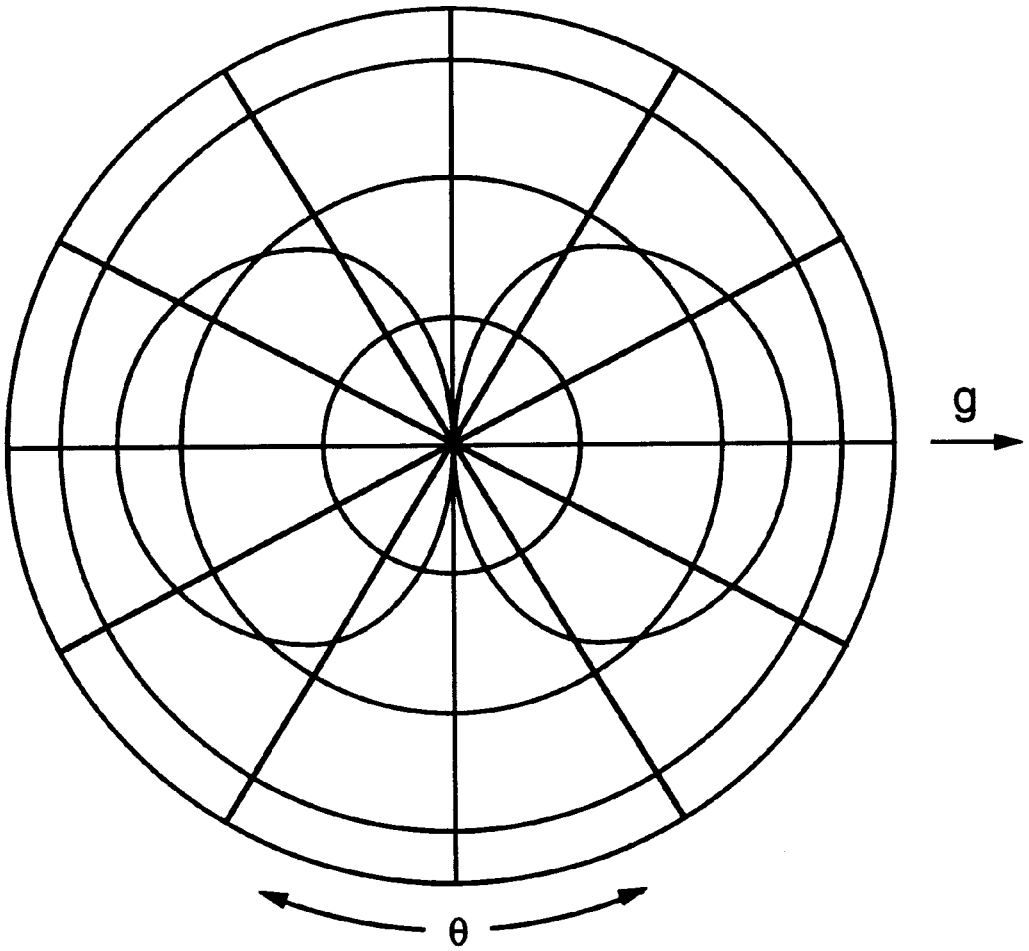
FIG. 62 is a representative elevation radiation pattern for the antennas of FIGS. 48, 52 or 56.

Referring to FIG. 62, a representative elevation radiation pattern for the electromagnetic antennas 48,48',66 of FIGS. 48,52,56, respectively, is illustrated. These antennas are linearly (e.g., vertically) polarized and have a physically low profile, associated with the minor diameter of the toroid form TF of FIG. 1, along the direction of polarization. Furthermore, such antennas are generally omnidirectional in directions that are normal to the direction of polarization, with a maximum radiation gain in directions normal to the direction of polarization and a minimum radiation gain in the direction of polarization.

The electromagnetic antennas 48,48',66 of FIGS. 48,52, 56, respectively, reduce the major diameter of the toroidal surface at resonance with respect to prior known antennas. The length of the electrical circumference of the minor toroidal axis is $\frac{1}{2}\lambda$, which is smaller by a factor of two than prior known antennas having a minimum electrical circumferential length of $\lambda$. The wave propagation velocity along the contrawound conductor circuits 50,50',68,70 is about two to three times slower than the design equations of Kandoian & Sichak. Accordingly, the major diameter of the toroidal surface is smaller by a factor of about four to six. Furthermore, only a single feed port of the signal terminals 52,54;52',54';72,74 is employed with the respective electromagnetic antennas 48;48';66 and, therefore, the task of matching the input impedance of such antennas to that of the transmission line for the respective signals 64;64;92 is easier. Moreover, the fundamental resonance of each of the electromagnetic antennas 48,48' provides a relatively wide bandwidth (e.g., about 10 to 20 percent of the fundamental resonance) in comparison with the corresponding first harmonic resonance in order to provide the widest bandwidth at the intended nominal operating frequency. Also, the performance of the exemplary electromagnetic antenna 48 is comparable to that of a vertical one-half wave dipole antenna and provides a greater specific communications range (e.g., greater than about 38 statute miles) over sea water than the range (e.g., about 12 statute miles) of a comparable quarter wave grounded monopole or whip antenna.

In addition to modifications and variations discussed or suggested previously, one skilled in the art may be able to make other modifications and variations without departing from the true scope and spirit of the invention.

I claim:

1. An electromagnetic antenna comprising:

a multiply connected surface having a major radius and a minor radius, with the major radius being at least as great as the minor radius;

insulated conductor means extending in a first helical conductive path around and over said multiply connected surface with a first helical pitch sense from a first node to a second node, said insulated conductor means also extending in a second helical conductive path around and over said multiply connected surface with a second helical pitch sense, which is opposite from the first helical pitch sense, from the second node to the first node in order that the first and second helical conductive paths are contrawound relative to each other and form a single endless conductive path around and over said multiply connected surface; and first and second signal terminals respectively electrically connected to the first and second nodes.

2. The electromagnetic antenna of claim 1 wherein said multiply connected surface is a toroidal surface.

3. The electromagnetic antenna of claim 1 wherein said insulated conductor means includes a single insulated conductor which forms the single endless conductive path.

4. The electromagnetic antenna of claim 1 wherein said insulated conductor means includes a first insulated conductor which extends from the first node to the second node, and a second insulated conductor which extends from the second node to the first node.

5. The electromagnetic antenna of claim 1 wherein said insulated conductor means includes:

first conducting means for conducting a first electric current in the first helical conductive path;

second conducting means for conducting a second electric current in the second helical conductive path;

first producing means for producing a first magnetic current from the first electric current in the first helical conductive path; and second producing means for producing a second magnetic current from the second electric current in the second helical conductive path.

6. The electromagnetic antenna of claim 5 wherein the first and second producing means include means providing constructive interference of the first and second magnetic currents in order to produce a transmitted signal from said electromagnetic antenna.

7. The electromagnetic antenna of claim 6 wherein the first and second conducting means include means providing destructive interference of the first and second electric currents.

8. The electromagnetic antenna of claim 1 wherein said signal terminals conduct an antenna signal having a nominal operating frequency; and wherein a length of said insulated conductor means in each of the helical conductive paths is about one-half of a guided wavelength of said nominal operating frequency.

9. An electromagnetic antenna comprising:

a multiply connected surface having a major radius and a minor radius, with the major radius being at least as great as the minor radius;

insulated conductor means extending in a first poloidal-peripheral winding pattern around and over said multiply connected surface with a first winding sense from a first node to a second node, said insulated conductor means also extending in a second poloidal-peripheral winding pattern around and over said multiply connected surface with a second winding sense, which is opposite from the first winding sense, from the second node to the first node in order that the first and second poloidal-peripheral winding patterns are contrawound relative to each other and form a single endless conductive path around and over said multiply connected surface; and first and second signal terminals respectively electrically connected to the first and second nodes.

10. The electromagnetic antenna of claim 9 wherein said multiply connected surface is a toroidal surface.

11. The electromagnetic antenna of claim 9 wherein said insulated conductor means includes a single insulated conductor which forms the single endless conductive path.

12. The electromagnetic antenna of claim 9 wherein said insulated conductor means includes a first insulated conductor which extends from the first node to the second node, and a second insulated conductor which extends from the second node to the first node.

13. The electromagnetic antenna of claim 9 wherein said signal terminals conduct an antenna signal having a nominal operating frequency; and wherein a length of said insulated conductor means in each of the poloidal-peripheral winding patterns is about one-half of a guided wavelength of said nominal operating frequency.

14. An electromagnetic antenna comprising:

a multiply connected surface having a major radius and a minor radius, with the major radius being at least as great as the minor radius;

insulated conductor means extending in a first generally helical conductive path around and over said multiply connected surface with a first helical pitch sense from a first node to a second node and from the second node to a third node, said insulated conductor means also extending in a second generally helical conductive path around and over said multiply connected surface with a second helical pitch sense, which is opposite from the first helical pitch sense, from the third node to a fourth node and from the fourth node to the first node in order that the first and second generally helical conductive paths are contrawound relative to each other and form a single endless conductive path around and over said multiply connected surface; and first and second signal terminals respectively electrically connected to the second and fourth nodes.

15. The electromagnetic antenna of claim 14 wherein said multiply connected surface is a toroidal surface.

16. The electromagnetic antenna of claim 14 wherein said insulated conductor means includes a single insulated conductor which forms the single endless conductive path.

17. The electromagnetic antenna of claim 14 wherein said insulated conductor means includes a first insulated conductor which extends from the first node to the second node and from the second node to the third node, and a second insulated conductor which extends from the third node to the fourth node and from the fourth node to the first node.

18. The electromagnetic antenna of claim 14 wherein the first and third nodes are generally diametrically opposed to the second and fourth nodes, respectively.

19. The electromagnetic antenna of claim 14 wherein said signal terminals conduct an antenna signal having a nominal operating frequency; and wherein a length of said insulated conductor means in each of the generally helical conductive paths is about one-half of a guided wavelength of said nominal operating frequency.

20. An electromagnetic antenna having an antenna signal comprising:

a multiply connected surface having a major radius and a minor radius, with the major radius being at least as great as the minor radius;

first insulated conductor means extending in a first generally helical conductive path around and partially over said multiply connected surface with a first helical pitch sense from a first node to a second node, and also extending in a second generally helical conductive path around and partially over said multiply connected surface with a second helical pitch sense, which is opposite from the first helical pitch sense, from the second node to the first node in order that the first and second generally helical conductive paths form a first endless conductive path around and substantially over said multiply connected surface;

second insulated conductor means extending in a third generally helical conductive path around and partially over said multiply connected surface with the second helical pitch sense from a third node to a fourth node, and also extending in a fourth generally helical conductive path around and partially over said multiply connected surface with the first helical pitch sense from the fourth node to the third node in order that the third and fourth generally helical conductive paths form a second endless conductive path around and substantially over said multiply connected surface, the first and third generally helical conductive paths being contrawound relative to the second and fourth generally helical conductive paths, respectively;

first signal terminal means electrically connected to at least one of the first and fourth nodes; and second signal terminal means electrically connected to at least one of the second and third nodes, said first and second signal terminal means for conducting the antenna signal.

21. The electromagnetic antenna of claim 20 wherein said multiply connected surface is a toroidal surface.

22. The electromagnetic antenna of claim 20 wherein said first and second insulated conductor means respectively include first and second insulated conductors which respectively form the first and second endless conductive paths.

23. The electromagnetic antenna of claim 20 wherein said first insulated conductor means includes a first insulated conductor which extends from the first node to the second node, and a second insulated conductor which extends from the second node to the first node; and wherein said second insulated conductor means includes a third insulated conductor which extends from the third node to the fourth node, and a fourth insulated conductor which extends from the fourth node to the third node.

24. The electromagnetic antenna of claim 20 wherein the antenna signal has a nominal operating frequency; and wherein a length of each of said first and second insulated conductor means in each of the generally helical conductive paths is about one-quarter of a guided wavelength of said nominal operating frequency.

25. The electromagnetic antenna of claim 20 wherein said first signal terminal means includes a first signal terminal which is electrically connected to only one of the first and fourth nodes; and wherein said second signal terminal means includes a second signal terminal which is electrically connected to only one of the second and third nodes.

26. The electromagnetic antenna of claim 20 wherein said first signal terminal means includes a first signal terminal which is electrically connected to the first node and a second signal terminal which is electrically connected to the fourth node; and wherein said second signal terminal means includes a third signal terminal which is electrically connected to the second node and a fourth signal terminal which is electrically connected to the third node.

27. A method of transmitting an RF signal with a toroidal antenna comprising:

applying said RF signal to first and second signal terminals in order to induce electric currents of said RF signal therebetween;

conducting a first electric current in a first conductor around and over a multiply connected surface having a major radius and a minor radius, with the major radius being at least as great as the minor radius, and with the first conductor having a first helical pitch sense from the first signal terminal to the second signal terminal;

conducting a second electric current in a second conductor around and over the multiply connected surface, with the second conductor having a second helical pitch sense, which is opposite from the first helical pitch sense, from the second signal terminal to the first signal terminal; and employing the first and second conductors in a contrawound relationship to each other.

28. The method of claim 27 including:

forming a single endless conductive path with the first and second conductors around and over the multiply connected surface.

29. The method of claim 28 including:

employing a nominal operating frequency of said RF signal; and employing a length of each of the first and second conductors of about one-half of a guided wavelength of said nominal operating frequency.

30. The method of claim 27 including:

producing a first magnetic current from the first electric current in the first conductor;

producing a second magnetic current from the second electric current in the second conductor; and providing constructive interference of the first and second magnetic currents in order to produce a transmitted signal from said toroidal antenna.

31. The method of claim 30 including:

providing destructive interference of the first and second electric currents.

* * * * *